US009376190B1

(12) United States Patent
Horan

(10) Patent No.: US 9,376,190 B1
(45) Date of Patent: Jun. 28, 2016

(54) OARLOCK SYSTEM

(71) Applicant: Richard Horan, Belle Harbor, NY (US)

(72) Inventor: Richard Horan, Belle Harbor, NY (US)

( * ) Notice: Subject to any disclaimer, the term of this patent is extended or adjusted under 35 U.S.C. 154(b) by 0 days.

(21) Appl. No.: 14/253,217

(22) Filed: Apr. 15, 2014

(51) Int. Cl.
*B63H 16/06* (2006.01)
*B63H 16/073* (2006.01)
*B63H 16/04* (2006.01)

(52) U.S. Cl.
CPC ..... *B63H 16/06* (2013.01); *B63H 16/073* (2013.01); *B63H 2016/043* (2013.01)

(58) Field of Classification Search
CPC ..... B63H 16/06; B63H 2016/063; B63H 16/067; B63H 16/073; A63B 22/0076
USPC ..... 440/101, 106, 107, 108, 109, 110
See application file for complete search history.

(56) References Cited

U.S. PATENT DOCUMENTS

| | | | | |
|---|---|---|---|---|
| 2,140,884 | A * | 12/1938 | Shape | 440/110 |
| 5,324,218 | A * | 6/1994 | Rijnders | B63H 16/04 416/74 |
| 8,002,598 | B2 * | 8/2011 | Ninham et al. | 440/107 |
| 2010/0035490 | A1 * | 2/2010 | Ninham | B63H 16/06 440/107 |
| 2011/0189910 | A1 * | 8/2011 | Sakellarides | B63H 16/04 440/101 |

* cited by examiner

*Primary Examiner* — Andrew Polay
(74) *Attorney, Agent, or Firm* — Michael J. Tavella

(57) ABSTRACT

An improved oarlock system having a sleeve that is attached to an oar, a set of cam blocks installed in the sleeve that can be moved to adjust the inboard of an oar, an oarlock that is positioned over the sleeve so that it contacts the cam blocks. There are several combinations of sleeve type and cam block available for use. The oarlock can be fitted to different sized pins. Pitch of the oar can be easily adjusted using the oarlock and sleeves. Improvements in the use of the sleeves, cam blocks and oarlock permit replacement of worn parts and increased stability of the components when in use as well.

17 Claims, 60 Drawing Sheets

OARLOCK SYSTEM

CROSS REFERENCE TO RELATED APPLICATIONS

This application claims benefit of Provisional application 61/748,156, filed Jan. 2, 2013

STATEMENT REGARDING FEDERALLY SPONSORED RESEARCH AND DEVELOPMENT

Not Applicable

BACKGROUND OF THE INVENTION

1. Field of the Invention

This invention relates to oarlock systems and particularly to oarlock systems having simplified inboard adjustment capabilities.

2. Description of the Prior Art

The oarlock system discussed in my previous application, U.S. Ser. No. 12/928,384, provided a more effective connection between the oar and the boat, resulting in better oar control by the rower/athlete. Better oar control means more consistent, strokes thereby producing more efficiency and speed. Further, the round shape of the sleeve and oarlock, as opposed to square shape of the current state of the art, is less unsettling to the shell, which allows it to move through the water with less resistance. Finally, the two stationary cams in the oarlock interact with the two rotating cam followers on the sleeve to assist the rower in positioning the blade at the proper angle at the catch and recovery. This capability, designed to replace the blade positioning assistance provided by the flat surfaces used on the current state of the art, greatly adds to oar control. Additionally, the round sleeve and oarlock, as opposed to the square sleeve and oarlocks currently in use, rotates smoother and with less noise, vibration and wear. The main advantage however is the improved connection between rower and shell.

BRIEF DESCRIPTION OF THE INVENTION

The present Improved Oarlock System builds on the original Oarlock System with the following new or improved functionalities:

A new pivoting system that positions the oar shaft closer to pin;

A new oarlock mounting system to accommodate different size pins;

An improved design that is more compatible with standard rigging tools;

A new system for positioning oarlock on pin using springs;

A new ability to lock the oar into the oarlock;

A new ability to limit blade depth;

Improved ability to row with the oarlock behind the pin;

A new method to assist the cams in holding blades in position using magnets;

Improved methods of moving and locking the cam blocks that control inboard;

Improved systems for mounting sleeves on oar shafts;

A new method for fine-tuning blade pitch on the oar;

A new two-part cam blocks to reduce friction and facilitate replacement;

An improved tool for mounting sleeve on oar with correct blade pitch;

Improved operation and use;

Improved material manufacturing and assembly; and

An improved design that is more compatible with standard rigging tools;

DETAILED DESCRIPTION OF THE INVENTION

Figure 1:
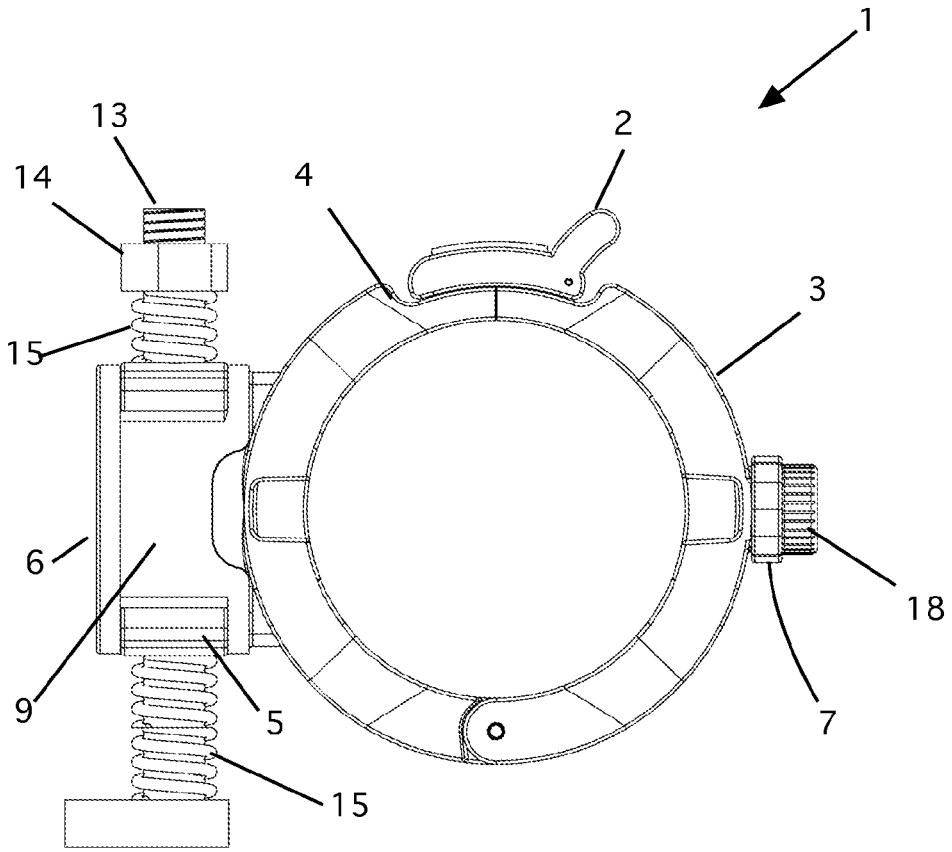
FIG. 1 is a front view of the oarlock assembly with spring spacers.

In this specification the following terms are used and defined herein as follows:

Blade—Flat, spoon or hatchet shaped end of the oar that pushes against the water and propels the shell.

Depth—The depth of an oar blade during the drive portion of the stroke.

Blade Pitch—The angle of oar's blade relative to the water measured in degrees from perpendicular.

Catch—The beginning of the stroke when the blade is positioned approximately perpendicular to the water so that it can enter the water cleanly.

Draw Latch—Also known as the gate. Keeps oarlock closed around sleeve.

Feather—Turning the blade parallel to the surface of the water on the recovery.

Inboard—The distance measured from the end of the oar handle to the oarlock. Changing inboard changes leverage or gearing making it easier or harder to pull the oar.

Latch—or Draw Latch, also known as the Gate—Keeps oarlock closed around sleeve.

Lateral Pitch—The tilt of the oarlock away from the centerline of the shell.

Leverage—Rigging determines how much leverage each rower has with the oar through the rigger. The four factors affecting the leverage are blade size, oar length, inboard length, and rigger spread.

Oar—A shaft with handle, sleeve and blade that the rower uses to move the shell through the water.

Oarlock—Also known as a rowlock and swivel—primarily responsible for connecting the oar to the Shell.

Oar Handle—the end of oar shaft that the rower holds.

Oar Shaft—A tube, usually made of composites, connecting the oar handle to the blade ends, with the sleeve in between that propels the shell through the water.

Outrigger—Extensions that hold the oarlocks away from the gunwales of the shell to provide more leverage.

Pin—A post, supported by outrigger and usually made of stainless steel, about which the oarlock swivels. Normally the oarlock is positioned on the stern side of the pin.

Pitch—The angle of inclination of the blade to the vertical during the propulsive phase of the stroke. This is dictated by both the stern and lateral pitch.

Pitch Gauge—A tool currently in use that measures the pitch of the inside of the oarlock.

Reverse Oarlock—When oarlock is positioned on the bow side of the pin.

Rowing—The act of propelling a boat with two or more oars or /sculls.

Scull—Can be used to describe both the oars and boat where the oarlocks are opposite each other so that one rower can operate a pair of oars, or sculls at one time. Sculling oars are smaller than sweep oars.

Sculling—a method of using oars to propel a boat through water using sculls.

Shell—Name for racing boats powered by rowers that are long, narrow and lightweight.

Sleeve—Cylindrical component, usually made of plastic, that is positioned about ⅓ of the way down the oar shaft between the handle and the blade.

Spacers—Disks that can be used above and below the oarlock to control oar height.

Span—In sculling, the locations of the primary fulcrums of the stroke, the oarlock pins as measured from the starboard oarlock pin to port oarlock pin.

Spread—in rowing, the location of the primary fulcrum of the stroke, the oarlock pin as measured from the centerline of the shell to the oarlock pin.

Stern Pitch—The tilt of the oar's blade from perpendicular during the drive.

Sweep—the type of shell where the oarlocks are staggered rather than opposite each other. Each rower uses two hands to control one oar. Sweep oars are larger than sculls.

Work Through—How far a rower is rigged in front of or behind the oarlock pin; or the location of the outside arc of the stroke in relation to the oarlock pin.

The first device is designed to reduce the distance between the oar shaft and pin. In the current state of the art the sleeve must be very loose in the oarlock to allow the square sleeve to rotate freely inside the larger square oarlock. Oarlocks currently in use can swivel from side to side; there is no need for them to pivot up and down because the loose connection provides enough free play.

One of the goals of the original and this system is to eliminate this free play. For this reason the round sleeve fits snugly inside the round oarlock. This lack of play requires a pivoting system in the oarlock to allow the oar blade and handle to move up and down, pivoting at the oarlock.

My previously filed pending patent application used a pivoting system that resulted in an increase in the distance between the oarlock and pin when compared to oarlocks currently in use. There is a desire to reduce this distance so as not to shorten the catch angle of the blade. This is important, as it is widely believed that the first half of a stroke provides most of the propulsion.

One embodiment of the invention reduces the space between the oar and pin by moving the pivot from between the oarlock and pin, to around the pin. This is referred to as the pin pivot system.

Figure 2:
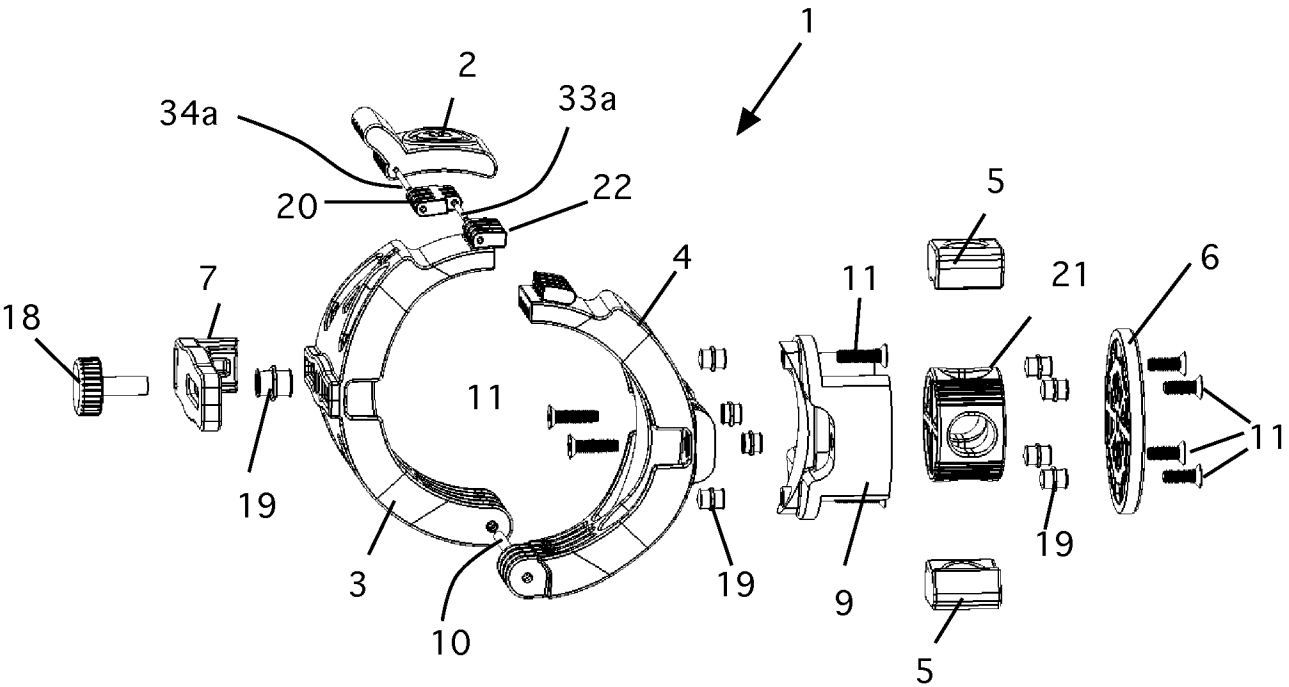
FIG. 2 is an exploded view of the oarlock assembly.
Figure 17:
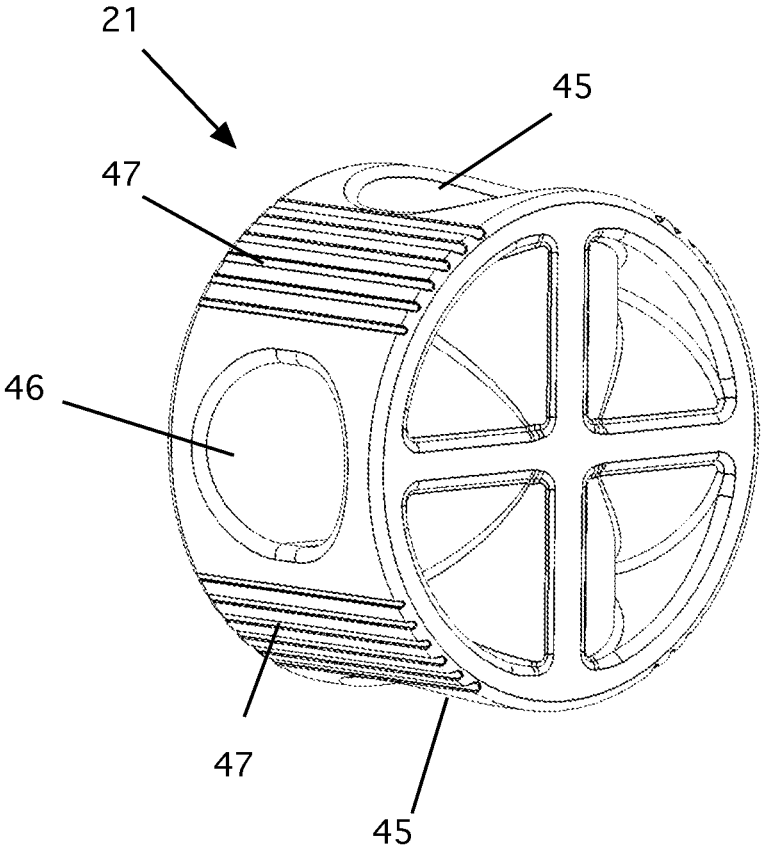
FIG. 17 is a perspective view of the oarlock dual pin disk.

Referring now to FIGS. 1-4, the pin pivot system for the pin 13 consists of four components that serve to hold the pin 13 (see FIG. 1) and allow the oarlock 1 to rotate around it. These components are the connector 9 (see also FIGS. 18 and 19), a dual pin disk 21 (see FIG. 2), two pitch/depth bushings 5, and a cap 6. Referring now to FIG. 17, the dual pin disk 21 (FIGS. 2 and 17) has two pairs of oblong holes 46 and 47 that allow it to slide over two different size pins and maintain the ability to change pitch. The dual pin disk itself does not rotate but instead stays in one position on the pin. The connector 9 (see FIGS. 2, 18 and 19) rotates around the dual pin disk. The connector is connected to the 1 oarlock on one side as shown in FIG. 2, using screws 11 and threaded inserts 19 (see FIG. 2). The dual pin disk is inserted into the connector 9 and a cap 6 closes the end. The cap is secured by 11 and threaded inserts 19 as shown. As shown in FIGS. 1 and 2, the pitch/depth bushings 5 fit snugly around the pin 13, positioned on the top and bottom of the dual pin disk. These pitch/depth bushings 5 serve two purposes: setting the pitch of the oarlock and limiting the depth of the blade, as discussed below.

As shown in FIG. 1, the pin 13 is mounted on the outrigger 16. Rather than using hard nylon spacers to set oarlock height, high-tension pin springs 15 are used. These springs are constructed of a non-corrosive material and serve two purposes: first, they absorb abnormal shocks that occasionally occur such as catching a crab. Second, they eliminate the need to have the exact size solid spacers without causing binding or free play. Like nylon spacers, the pin springs come in different diameters and length, but are more forgiving than the spacers and easier to adjust.

Figure 3:
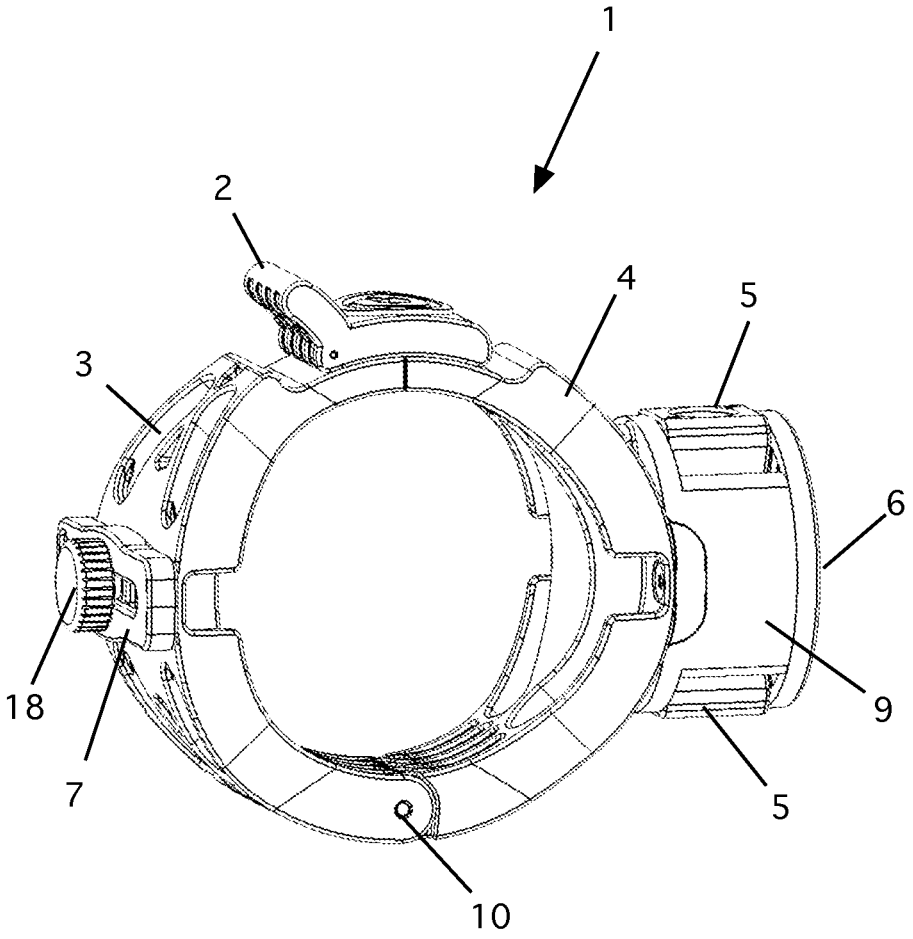
FIG. 3 is a perspective view of the lock side of the oarlock assembly.
Figure 4:
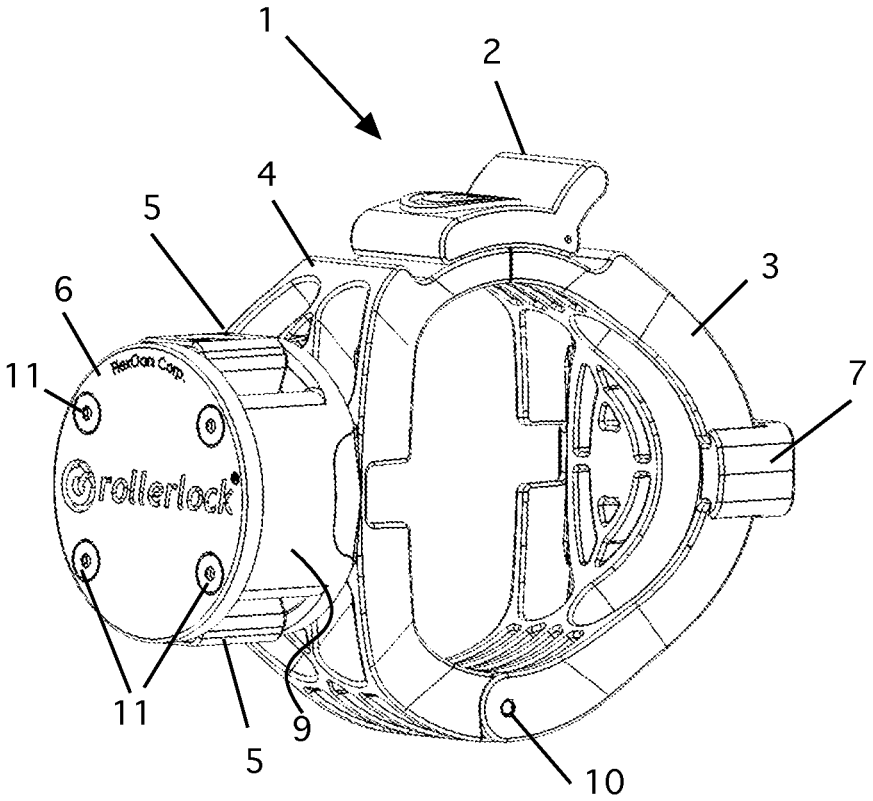
FIG. 4 is a perspective view of the pin side of the oarlock assembly.
Figure 5:
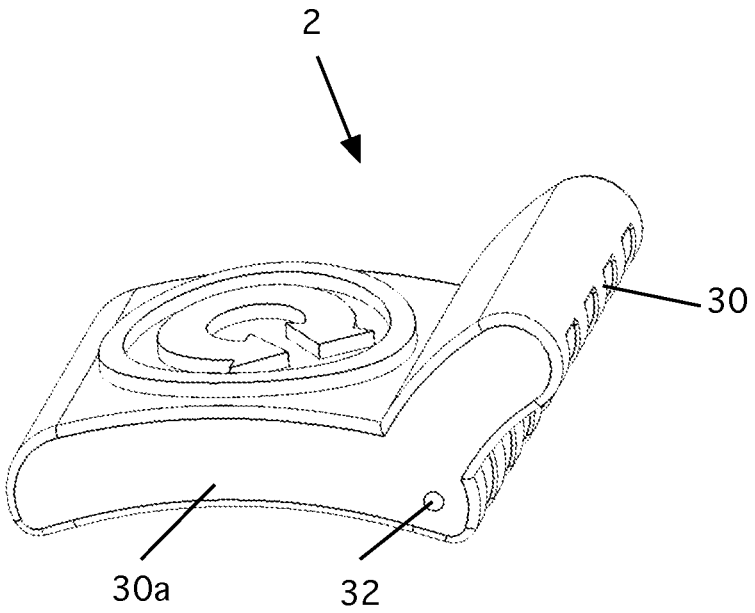
FIG. 5 is a top perspective view of the oarlock latch.
Figure 6:
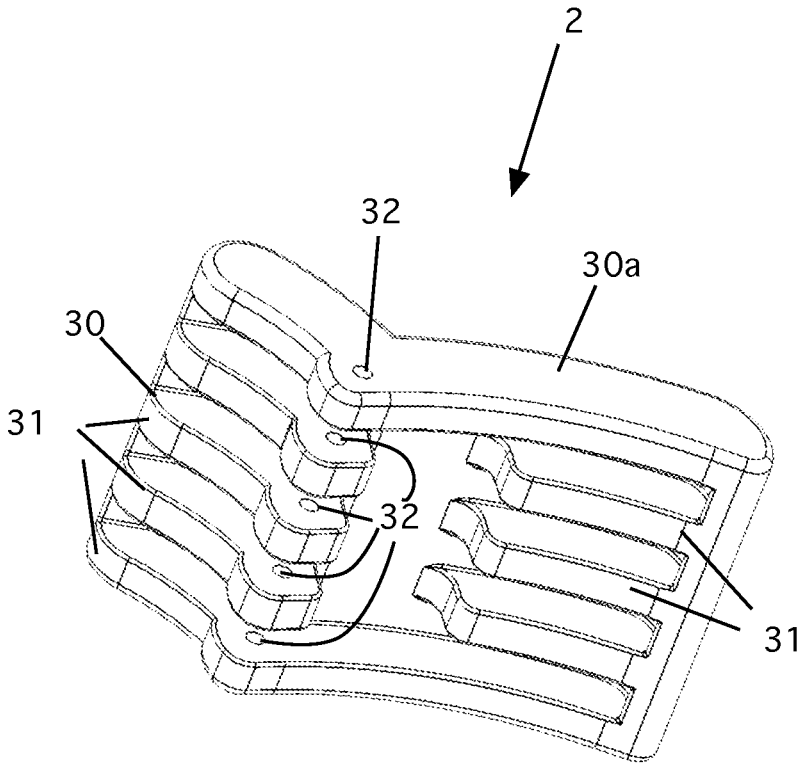
FIG. 6 is a bottom perspective view of the oarlock latch.
Figure 7:
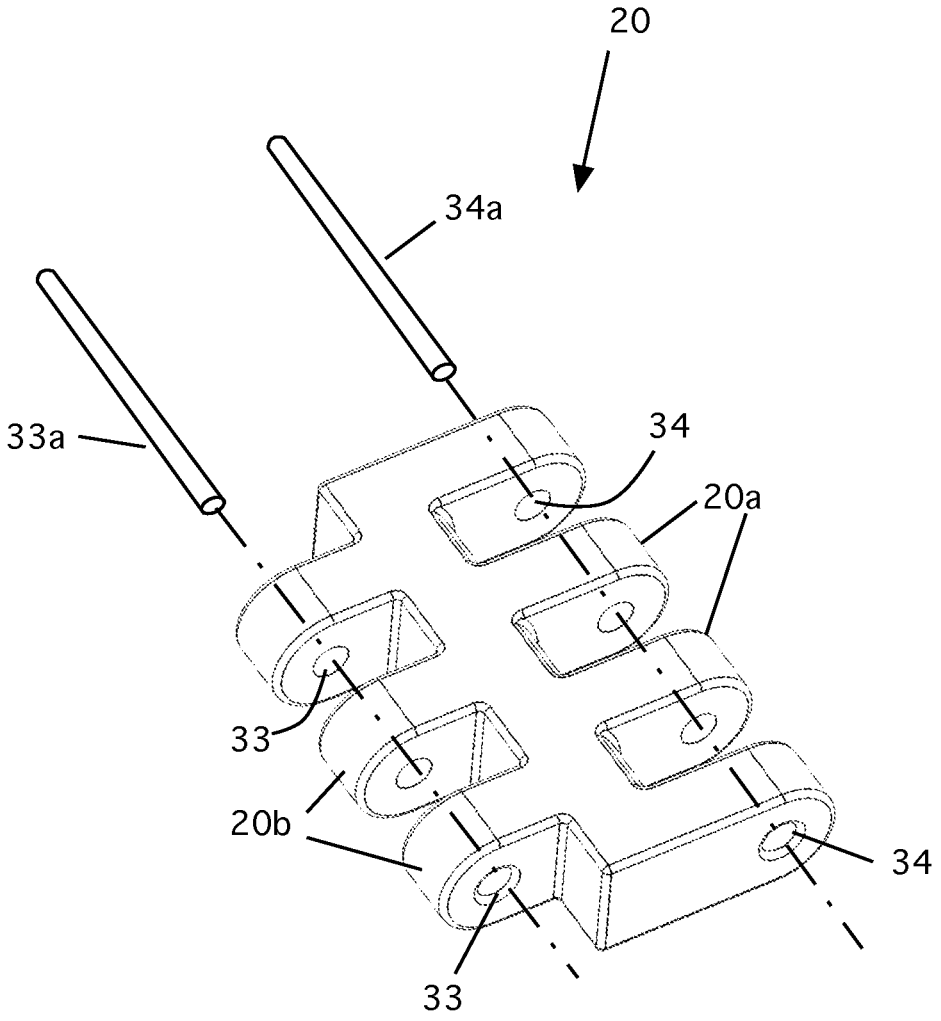
FIG. 7 is a perspective view of the oarlock latch hinge lever.

As shown in FIGS. 1-4, the present invention uses a round oarlock where conventional oarlocks are square. The oarlock 1 consists of two semicircular members designated as the oarlock lock side half 3 and the pin side half 4, to which the pin 13 is attached. See also FIGS. 8, 9 and 10. The two components are connected by a pin 10 (see FIG. 2) at their bases, as shown. This pin acts as a hinge that allows the two pieces to open and close. At the top of the oarlock 1, the two sides are connected by a hinged latch 2. The latch 2 is secured to the oarlock by means of the oarlock latch hinge lever, as described below. FIG. 5 is a top perspective view of the oarlock latch. The latch 2 has a curved grip portion 30 and a curved lower body 30*a*. At the bottom of the grip portion 30 is a hole 32 that accepts a hinge pin, as discussed below. FIG. 6 is a bottom perspective view of the oarlock latch. In this view, the back of the grip portion 30 and the bottom of the curved base portion 31 are shown. Note that the bottom of the latch is ribbed with ribs 31*a* and that the holes 32 penetrate all of the ribs. FIG. 7 is a perspective view of the oarlock latch hinge lever 20. The latch hinge lever 20 is the member that secures the latch to the oarlock pieces 3 and 4. The latch hinge lever 20 has two sets of ribs, as shown. On one side, four ribs 20*a* are provided, each having a hole 34 as shown. On the other side, three ribs 20*b* are provided, each having a hole 33. As shown in FIG. 2, the side 20*a* of the latch hinge lever 20 is secured to the latch 2 with a pin 34*a*. In this way, the latch hinge lever 20 is hingably secured to the latch 2. The other side, 20*b* of the latch hinge lever 20 is secured to the ribbed block 28 on the lock side half 3 (see FIG. 8) using pin 33*a*. In this way, the latch 2 can be lifted and hinged over so that the ribs under the front 2*a* of the latch engage the ribs on the oarlock pin side 4. Once these ribs are engaged, the latch 2 is pulled back and down until it sits flush on the top of the two connected halves of the oarlock, as shown in FIGS. 1, 3 and 4. To open the oarlock, the latch is simply lifted until the front 2*a* of the latch is free of the ribs 22 on the lock side 3 of the oarlock. Then, the latch can be lifted and the oarlock sides separated.

Figure 8:
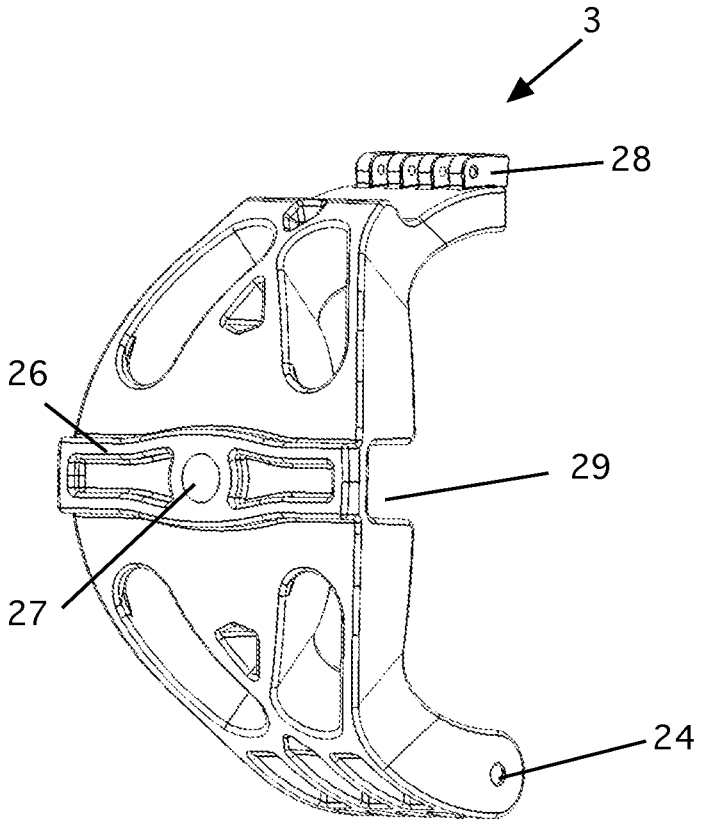
FIG. 8 is a perspective view of the outside view of the lock side half of the oarlock.

FIG. 8 is a perspective view of the outside view of the lock side half 3 of the oarlock. As shown, this sidepiece is a formed member. At the top is the ribbed block 28, for attached the latch hinge lever 20, as discussed above. At the base, a hole 24 accepts pin 10 to hinge the two oarlock pieces together. A formed section 26 has a center hole 27 to hold the thumbscrew 18 that secures the lock 7. Note that the lock 7 (see FIG. 11) fits across the formed section 26. The lip 35 of the lock 7 fits into the opening 29 (see FIG. 4). Note there is only one opening 29. The other side of the oarlock half 3 has no opening. This opening 29 allows the cam 54 (see FIG. 21) to slide into the oarlock, to mount the oarlock onto the sleeve assembly 51 (also on FIG. 21), as discussed further below.

Figure 9:
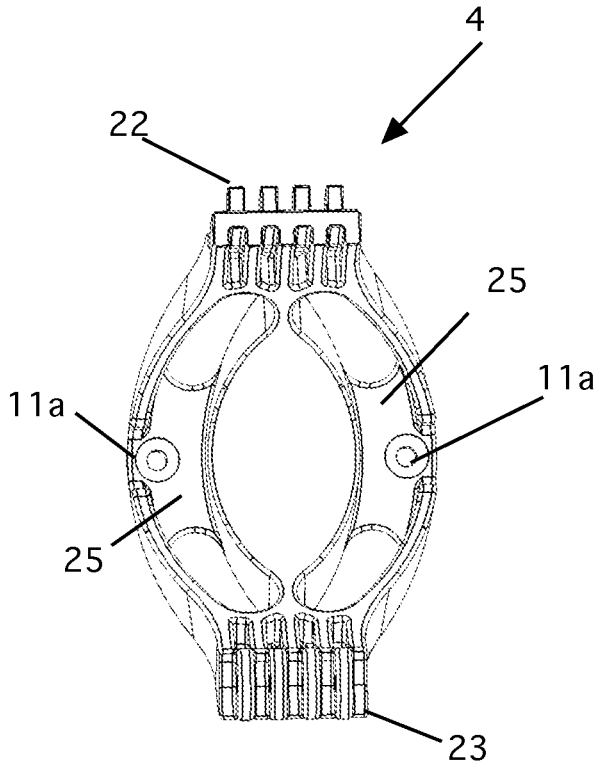
FIG. 9 is a front view of the inside view of the pin side half of the oarlock.
Figure 10:
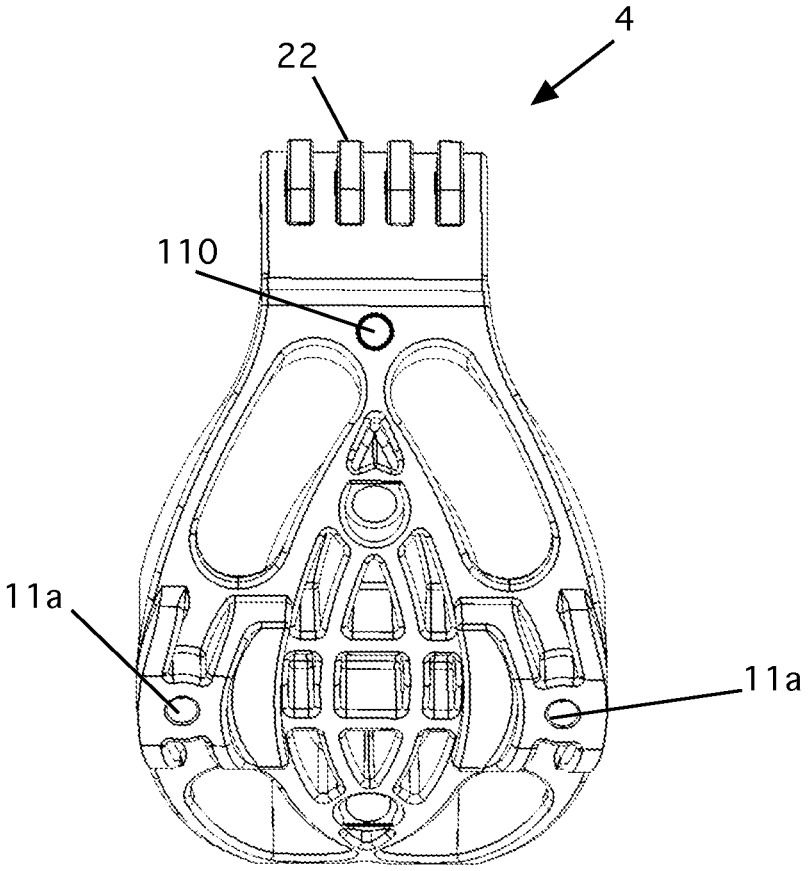
FIG. 10 is a side view of the outside view of the pin side half of the oarlock.

FIG. 9 is a front view of the inside view of the pin side half 4 of the oarlock. FIG. 10 is a side view of the outside view of the pin side half 4 of the oarlock. Here, the ribs 22 are shown in the top of the pin side half 4, as discussed above. Two holes 11*a* are provided for the screws 11 to attach the connector 9 to the pin side (see FIG. 2). At the base, drilled ribs 23 are used to accept the hinge pin 10. Two cam channels 25 are provided to allow the oarlock to be used on either side of the boat as well as on either side of the pin. As discussed below, to row behind the pin the oarlock is rotated the oarlock 180 degrees. Note that a hole 110 is shown near the top. This hole is used to hold a cylindrical magnet as discussed below.

Figure 11:
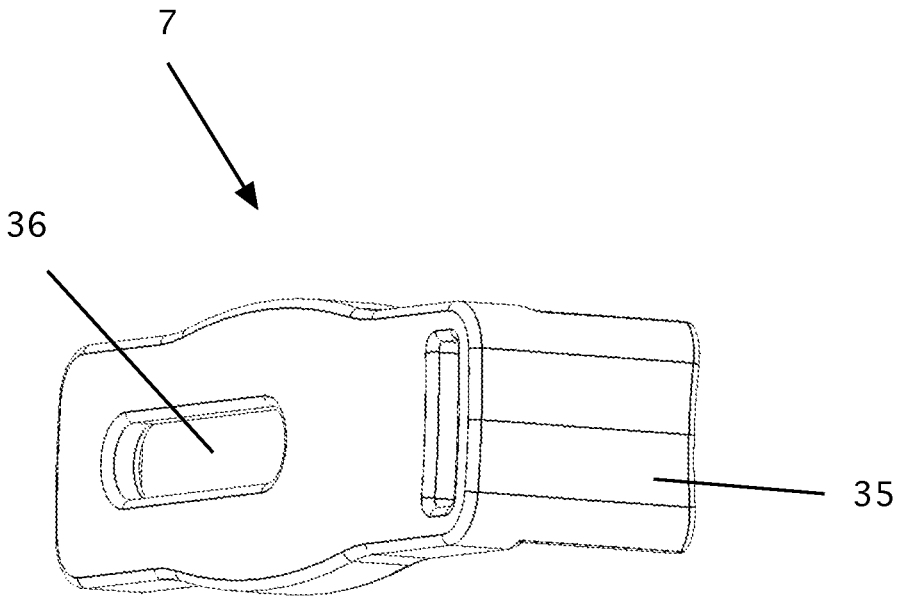
FIG. 11 is an outside perspective view of the oarlock lock.
Figure 12:
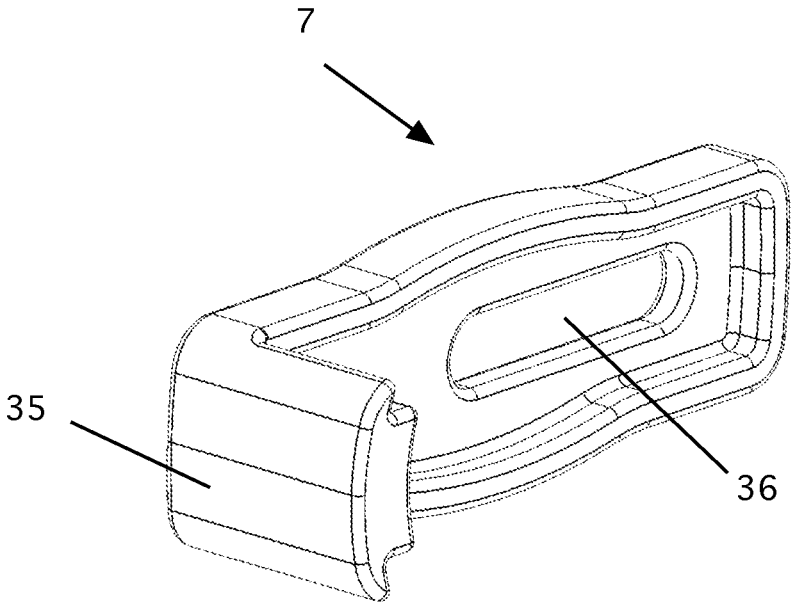
FIG. 12 is a perspective view of the inside of the oarlock lock.
Figure 13:
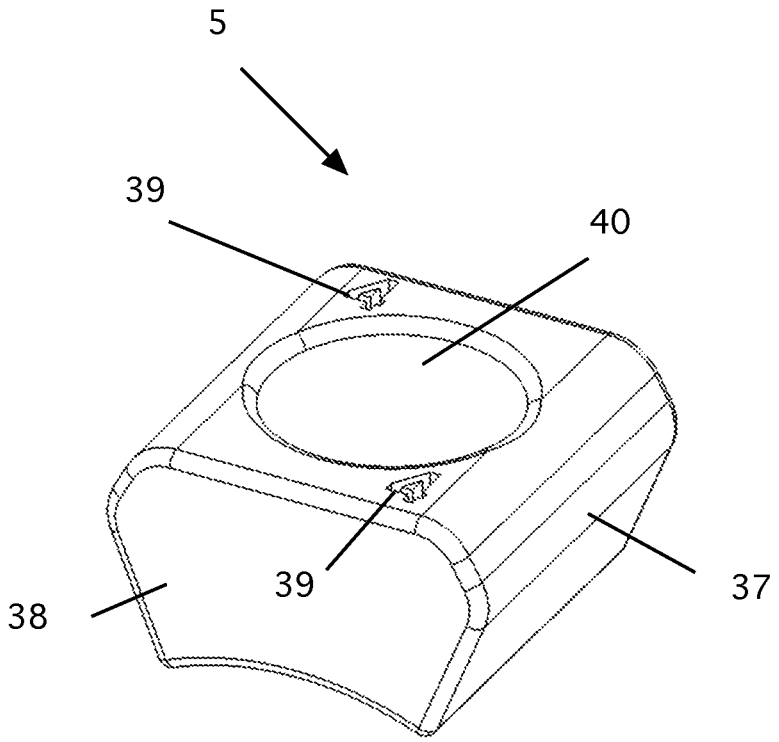
FIG. 13 is a perspective view of the oarlock pitch/depth bushings.

FIG. 11 is an outside perspective view of the oarlock lock 7. FIG. 12 is a perspective view of the inside of the oarlock lock 7. As noted above, the oarlock lock 7 (see FIG. 11) fits across the formed section 26 of the oarlock piece 3 (see FIG. 2). The oarlock lock 7 has a lip 35 and a slot 36. The lip fits into the opening 29 of the oarlock piece 3 (see FIG. 4) and the slot accepts the thumbscrew 18. The purpose of the oarlock lock 7 is further discussed below. FIG. 13 is a perspective view of one of the oarlock pitch/depth bushings 5. As noted above, the pitch/depth bushings are positioned on the top and bottom of the dual pin disk 21 and between the cap 6 and connector 9. Each bushing has a top surface with a center hole 40 that accepts the pin 13. Two of the sides 37 of the bushing are canted as shown. The other two sides 38 are flat. Varying the distance between the depth adjustment sides 37 of the pitch/depth bushings and connector blade angle stops 48 (see below) changes the degree the oarlock can pivot, which in turn controls the oar angle and therefore blade depth. Increase the space between the pitch/depth bushings and connector and blade depth increases. Decrease the space and blade depth decreases. Limiting blade depth can be accomplished in several ways: by increasing the width of the pitch/depth bushings or by reducing the opening in the connector.

In addition to blade depth, the pitch/depth bushings 5 also help to control blade pitch. As in the current state of the art these parts provide rowers and coaches with the ability to add or subtract up to 3 degrees of pitch to the oarlock (discussed further below). Markings 39 on the pitch/depth bushings 5 follow standard conventions with the following numeric system (note FIG. 13 shows a 4/4 marking): 4/4=zero additional pitch, 5/3=+1 degree, 6/2=+2 degrees, 7/1=+3 degrees, 3/5=−1 degree, 2/6=−2 degrees, and 3/7=−3 degrees.

Figure 14:
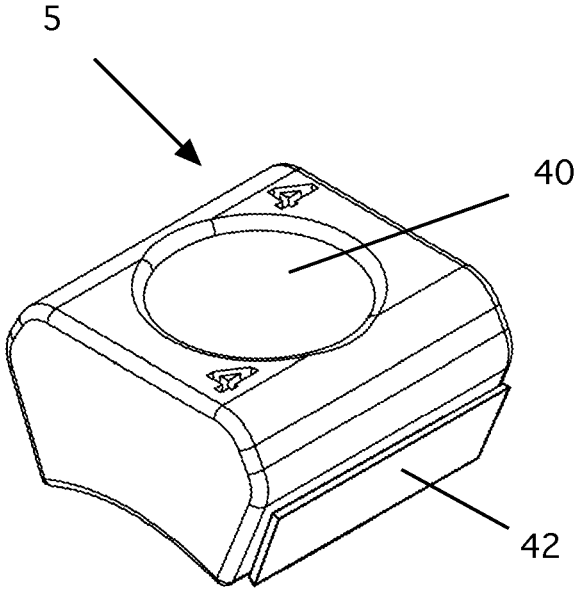
FIG. 14 is a perspective view of the oarlock pitch/depth bushing assembly.

FIG. 14 is a perspective view of the oarlock pitch/depth bushing assembly showing an adhesive spacer pads 42 attached. Note that the adhesive spacer pads 42 are shown on the angled sides 37 of the pitch/depth bushings. The pads 42 are the preferred method of adjusting the distance between the pitch depth bushings 5 and the connector 9. The pads 42 can be of differing thicknesses depending on the desired limitation oar angle (blade depth). It is also possible to use a spacer pad 42 on just one side of the pitch/'depth bushing 5 thereby limiting just blade depth and not blade height, or vice versa. Similarly pads of different thicknesses can be used on either side 37 of the bushing.

Figure 15:
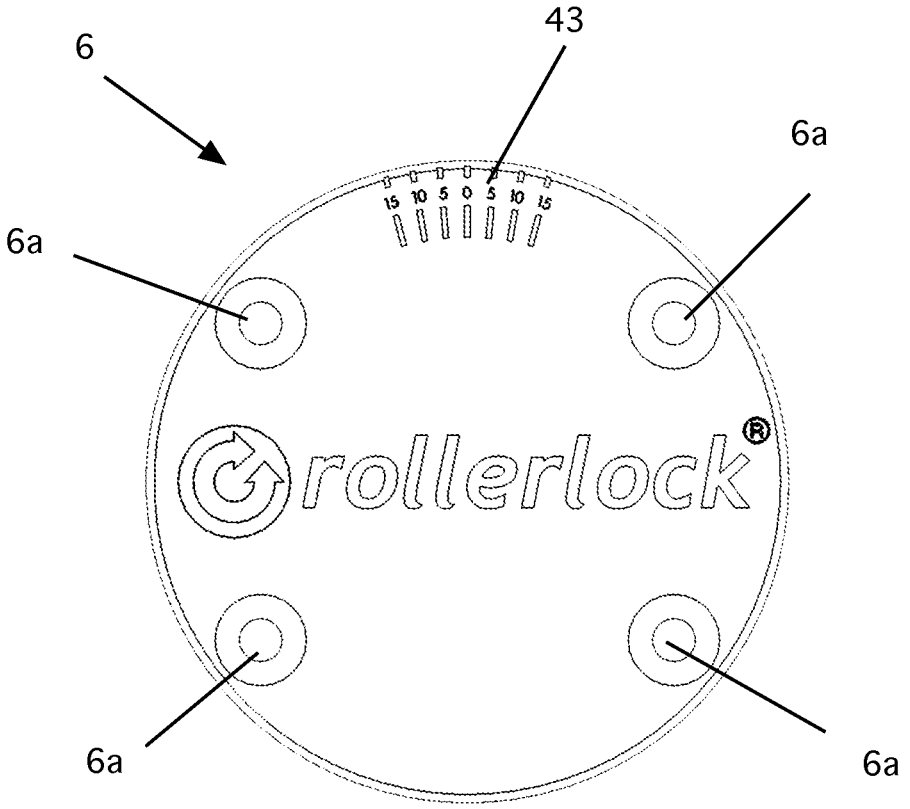
FIG. 15 is a front view of the outside of the oarlock cap.
Figure 16:
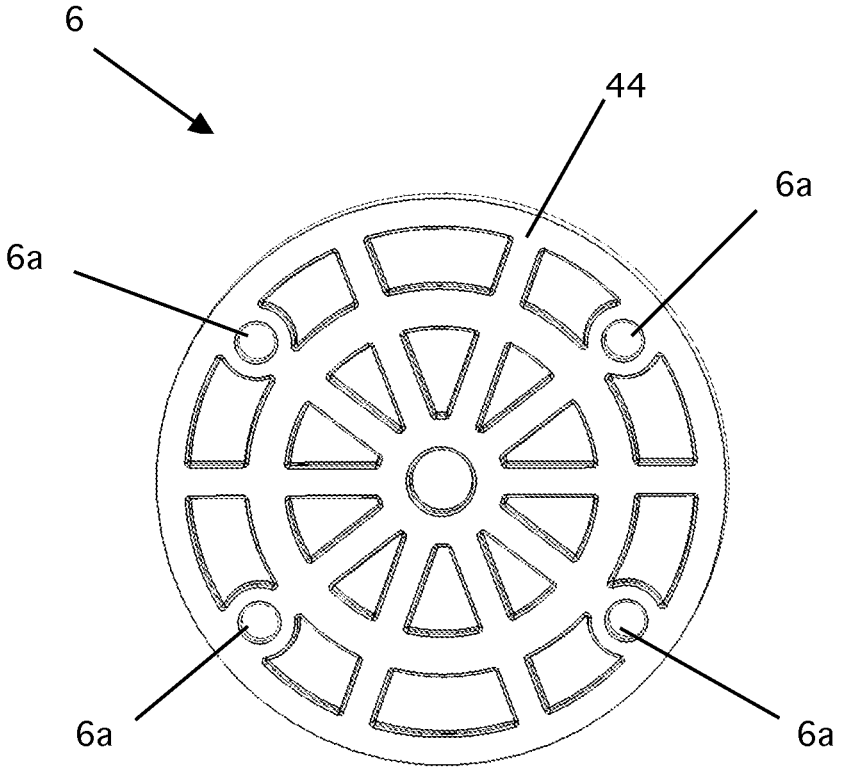
FIG. 16 is a front view of the inside of the oarlock cap.

FIG. 15 is a front view of the outside of the oarlock cap 6. FIG. 16 is a front view of the inside 44 of the oarlock cap 6. The cap 6 has two main functions; first, it serves to cover the connector and the dual pin disk 21 that holds the oarlock on the pin. Second, it provides a flat vertical surface. Because the present invention uses a round oarlock (where conventional oarlocks are square), existing pitch gauges that rely on the flat vertical surface inside the traditional oarlock, will not work with the circular design. Thus, the cap 6 is used to provide that surface. Standard pitch gauges can rest on this plane and should measure zero pitch, rather that 4 degrees for oarlocks typically in use today.

Moreover, as shown in FIG. 15 the cap 6 features an oar angle indicator 43. When the oar is perfectly level, the middle of the pitch/depth bushings 5 line up with the zero hash mark. When the oar is tilted one way or the other, the actual oar angle is shown on the cap.

Finally, holes 6*a* are shown. These holes accept the fasteners 11, as discussed above.

FIG. 17 is a perspective view of the oarlock dual pin disk. In sweep rowing there are two "standard" size pins, 9/16" and 13 mm. In sculling there are two "standard" size pins, ½" and 13 mm. So the problem is how to accommodate both.

FIG. 17 shows the dual pin disk 21 that solves that problem by incorporating two different size holes one large 46 and one small 45 that pass through it at 90 degrees to each other. This arrangement provides the ability to use one oarlock for either size pin 13 size. For sweep rowing there is typically a 9/16" hole and a 13 mm hole. In the Scull implementation not illustrated the holes are 13 mm and ½". If other pin sizes are desired, the dual pin disk can be resized accordingly.

The holes in the dual pin are oblong to allow the oarlock to tilt 3 degrees of positive or negative stern pitch. The actual blade pitch is determined by the type and orientation of the pitch/depth bushings 5, which fit on the top and bottom of the dual pin disk as shown in FIG. 4.

The dual pin disk itself does not rotate but instead stays in one position on the pin. The connector 9 rotates around the dual pin disk and is connected to the oarlock—pin side half 4 on one side and the cap 6 on the other. The dual pin disk is sandwiched between these two parts, which are held together by fasteners 11, and threaded inserts 19. When not mounted on the pin, the dual pin disk is free to rotate.

When the oarlock is about to be mounted on the pin, the rower/coach needs to easily be able to easily rotate the dual pin disk and then be able to correctly determine which hole should be selected. The dual pin disk includes finger grips 47, which address both of these needs. First, a series of lines from one side of the dual pin disk to the other are arranged so there is more space between the lines and the smaller hole 45 than the larger one 46. This makes it easy to see which is which. Second, the lines make it easy to grip the dual pin disk and turn it, even when wet.

As shown, the disk 21 has four holes. Two smaller holes 45 and two larger 46. When the oarlock is about to be mounted on the pin 13, the rower/coach needs to easily be able to rotate the dual pin disk 21 and then be able to correctly determine which hole should be selected. The dual pin disk includes finger grips 47, which address both of these needs. First, a series of lines from one side of the dual pin disk to the other are arranged so there is less space between the lines and the smaller holes 45 than the larger ones 46; this makes it easy to see which is which. Second, the lines make it easy to grip the dual pin disk and turn it, even when wet.

Figure 18:
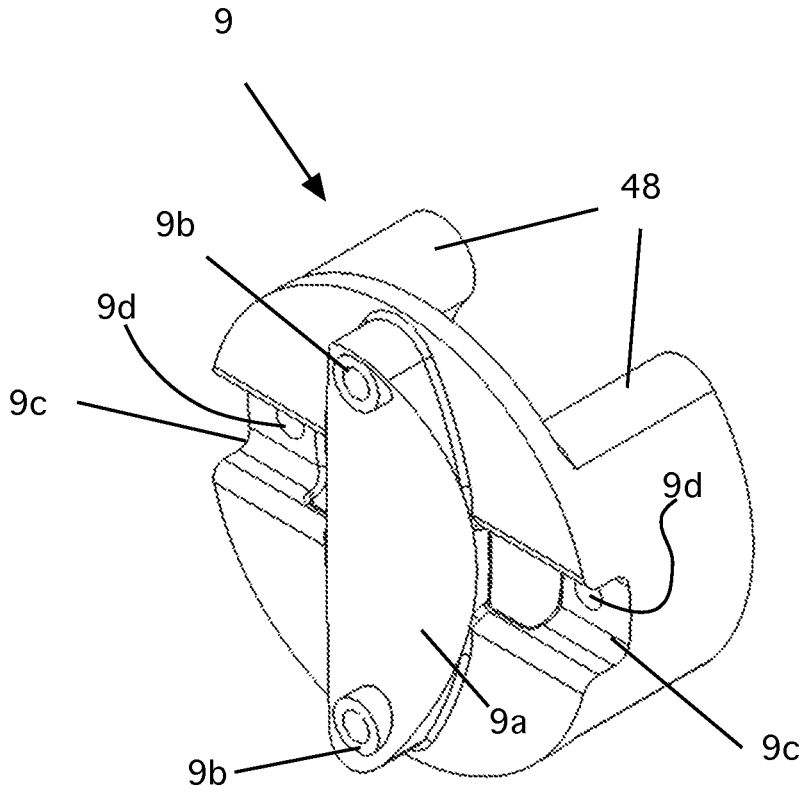
FIG. 18 is a perspective view of the oar side of the oarlock connector.
Figure 19:
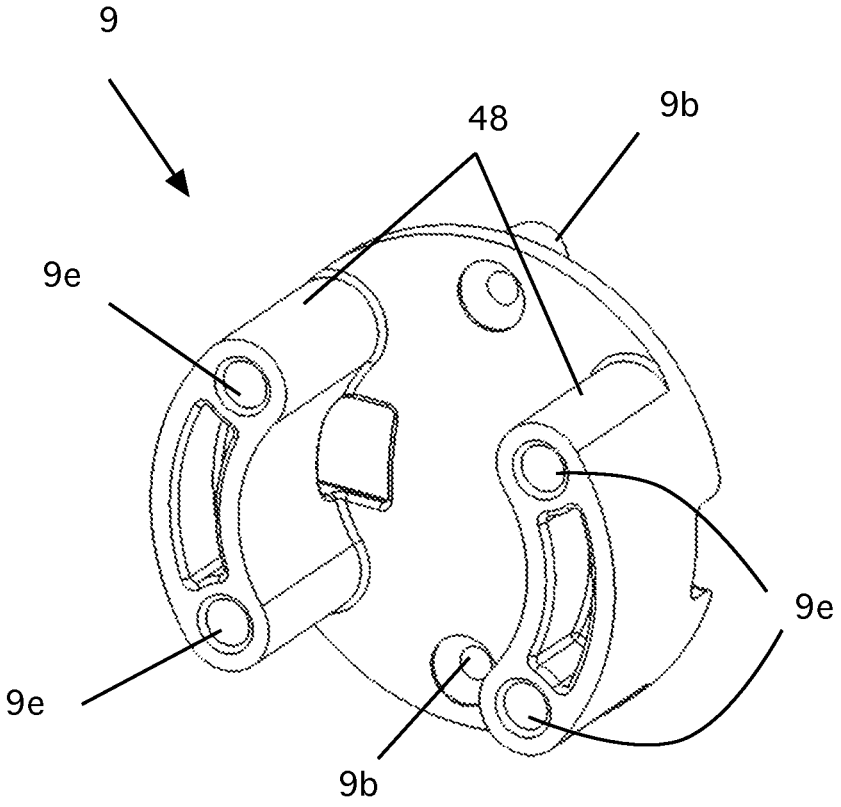
FIG. 19 is t a perspective view of the pin side view of the oarlock connector.

FIG. 18 is a perspective view of the oar side of the oarlock connector 9. FIG. 19 is a perspective view of the pin side view of the oarlock connector 9. As shown, the connecter 9 is a formed member that has, on the oarlock side, has a curved face 9*a* and two screw holes 9*b*, to accept fasteners 11 to secure the connecter 9 to the oarlock piece 4. In addition, a trough 9*c* is formed to accept the raised portions 4*a* (see FIG. 10) on the oarlock piece 4. Holes 9*d* are provided to secure the cap 6 using fasteners 11, as discussed above. As shown in FIG. 19, the pin side of the connecter shows the holes 9*b* as wells as the connector blade angle stops 48.

As discussed above, the pitch/depth bushings 5 are positioned on the top and bottom of the dual pin disk 21 and between the cap 6 and connector 9. Varying the distance between the depth adjustment sides 37 of the pitch/depth bushings 5 and connector blade angle stops 48 changes the degree the oarlock can pivot which in turn controls the oar angle and therefore blade depth. Increasing the space between the pitch/depth bushings and connector increases the blade depth. Decreasing the space decreases the blade depth. Limiting blade depth can be accomplished in several ways, by increasing the width of the pitch/depth bushings 5 or by reducing the opening in the connector. As discussed above, the preferred way to accomplish this is through the use of adhesive spacer pads 42 as discussed above.

Note that holes 9*e* are shown to receive the fasteners 11 to secure the cap 6 in place.

Figure 20:
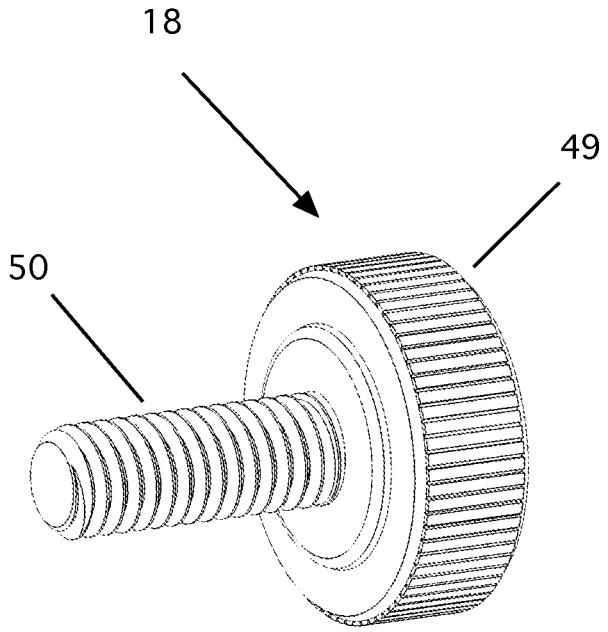
FIG. 20 is a perspective view of the oarlock thumbscrew for the lock.

FIG. 20 is a perspective view of the oarlock thumbscrew 18 for the oarlock lock 7. Here, the thumbscrew 18 has a knurled cap 49 and threads 50 as shown.

One advantage and one major difference of this new design over traditional oarlocks is the position of the pin 13. Almost all rowing shells are rigged with the oarlock in front of the pin. In rowing, this means the stern side of the pin because the rower is facing backwards. Mechanically speaking this arrangement makes sense because the rowing pressure is pushing into the pin, not pulling it. At the same time there is a general desire in the rowing community to increase catch angles, especially in sweep boats. Currently the best catch angle in sweep boats is about 100 degrees (a bigger catch angle means a longer, more effective stroke), while in sculling it could be as much as 115 degrees.

This disparity has prompted some innovators to experiment with reverse rowing or positive offset where the oarlock is moved behind the pin. Today's oarlocks however do not allow for this orientation for a couple of reasons. First, they have a built-in pitch of 4 degrees, which turns into −4 degrees if you turn the oarlock around. Secondly, the looseness of the oar in the oarlock is exacerbated when reversed, making this setup unusable.

Unlike the current state of the art, the oarlock described above is pitched at zero degrees. This arrangement lends itself perfectly to rowing behind the pin. The oarlock assembly above includes two pairs of cam channels 25 (see FIG. 9). The cam channels 25 not only allow the oarlock to be used on either side of the boat, but also on either side of the pin. To row behind the pin the oarlock is simply rotated 180 degrees.

Rowing behind the pin puts tremendous tensile forces on the oarlock, as opposed to the more manageable compressive forces seen when rowing "normally" in front of the pin. In order to deal with increased forces, the design is preferably fortified in three ways: using reinforced composite material, using longer fasteners 11 and longer threaded inserts 19, and epoxy to hold components together. The fasteners and threaded inserts are discussed above. The use of the epoxy is discussed below.

The oarlock is designed to attach to the oar using a sleeve and cam combination. In rowing, it is desirable to keep the sleeve firmly against the oarlock at all times. The main reasons are oar control and maintaining an efficient stroke. There are several reasons why this doesn't always happen, but usually it is either because of sloppy rowing on the part of the athlete or rough water conditions.

The original oarlock system in my currently pending application was designed so that the cam blocks can easily slide into the enclosed cam track. When oriented horizontally they line up with openings that allow the cam blocks to slide into position and rotate from catch to feather position.

In that original design when it is necessary for the rower to quickly extract the oar from the oarlock, the rower simply pulls on the oar handle and twists the handle in the direction of the openings. The downside with this system is when the rower accidentally pulls the oar out during a stroke it might take a few seconds to reinsert the oar back into the oarlock. The ability to extract the oar is not only a convenience but also a safety issue. Still, there may be situations where locking the oar into the oarlock is desired. The present invention describes a system and method to do this.

FIG. 3 shows the lock 7 in the open position while FIG. 4 shows the lock in the closed position. The lock mechanism consists of four parts, the thumbscrew for lock 18, the lock 7, the threaded insert 19 which is permanently molded into the oarlock—lock side 3.

In operation the lock 7 is positioned so that the lip 35 fits into the opening 29. The lock 7 is held tightly in place by the thumbscrew 18. The oar can be locked in the oarlock as follows. After the oarlock has been mounted to oar and the cam block 54 is in position, the thumbscrew 18 is loosened and the lock 7 is turned 180 degrees using the slot 36 on lock 7. Then, the thumbscrew 18 is retightened. As shown in FIG. 4, in the closed or locked position, the lip 35 of the lock covers the oarlock opening 29, which prevents the cam block 54 from being removed, thus locking the oarlock onto the oar. To remove the oar, the reverse procedure is used.

As noted above, the oar is placed in the oarlock using a sleeve and cam system. In my previous application, the sleeve and cam system worked well, but they have been improved.

Figure 21:
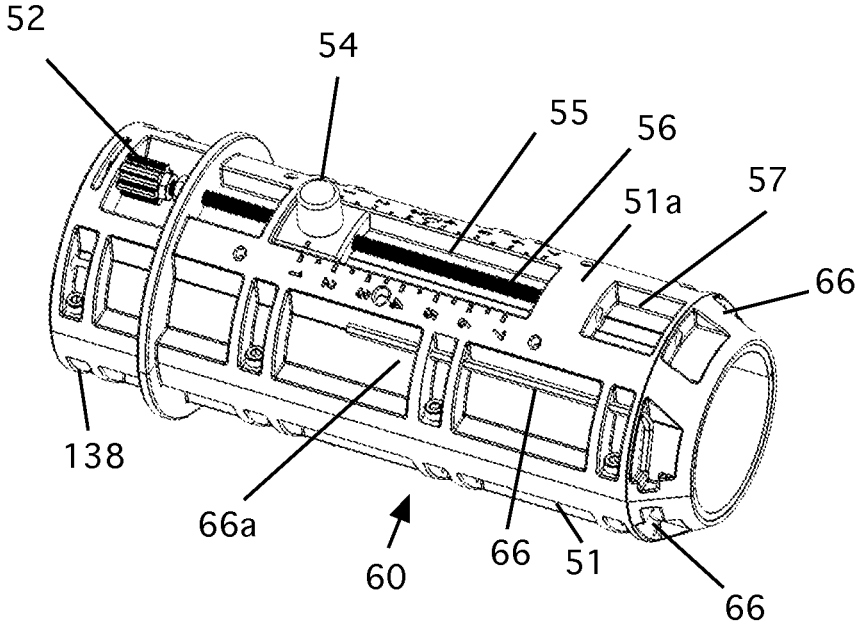
FIG. 21 is a perspective view of the blade end of the threaded sleeve collar (bolted) assembly sans collar.

Referring now to FIG. 21 is a perspective view of the threaded sleeve collar assembly, without the collar, is shown. Here, the sleeve consists of two halves, 51 and 51*a* that are bolted together (see FIG. 43). When bolted onto the oar, they form a single assembly 60 as shown in FIG. 21. Inside each half of the sleeve assembly 60 is a spur gear 52, a threaded cam block 54, and a threaded rod 56, onto which the cam block 54 is threaded. An inboard adjustment channel 55 is formed in the assembled sleeves 60 as shown. The assembled sleeves 60 have other openings, such as the adjustable cam block bay 57 and the hexagonal wrench bays 66. The use of these parts is discussed below. Note also for orientation purposes, the blade end of the assembled sleeves 60 is shown as 138 and the tapered blade end of the assembled sleeves 60 is shown as 140.

Figure 22:
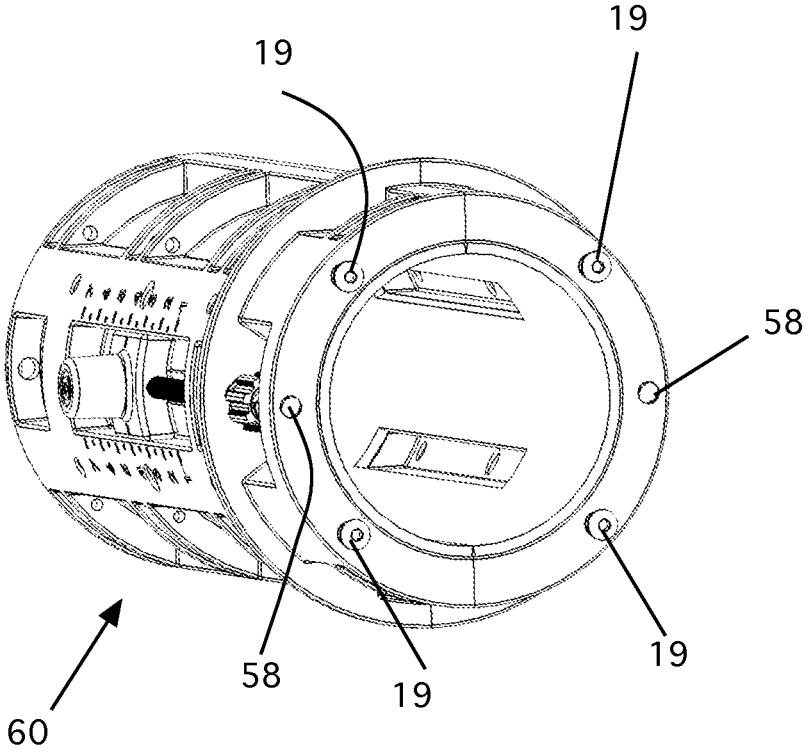
FIG. 22 is a perspective view of the handle end of the threaded sleeve collar (bolted) assembly sans collar

FIG. 22 is a perspective view of the handle end of the threaded sleeve collar (bolted) assembly sans collar. In this view, access holes 58 for the threaded rods 56 are shown as well as threaded inserts 19 for use the bolted collar and end cap (see FIG. 23).

Figure 23:
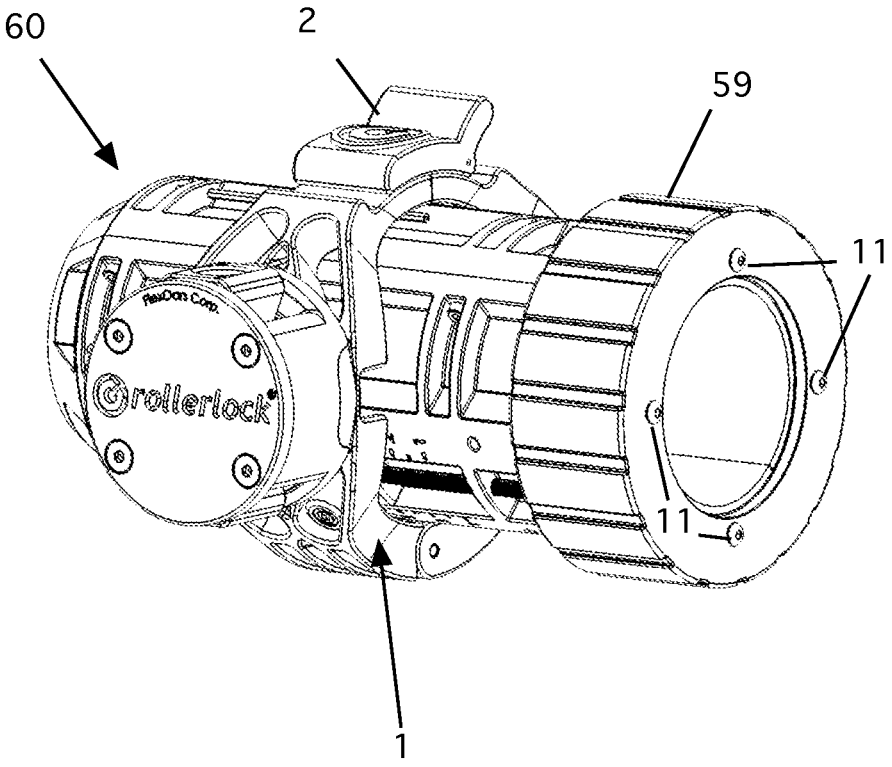
FIG. 23 is a perspective view of pin side of the bolted sleeve collar (bolted) and oarlock assembly.

FIG. 23 is a perspective view of pin side of the threaded sleeve collar and oarlock assembly. Here, the oarlock assembly 1 is attached to the sleeve as shown. Note that the collar 59 is shown bolted to the assembled sleeves 60 using fasteners 11.

Figure 24:
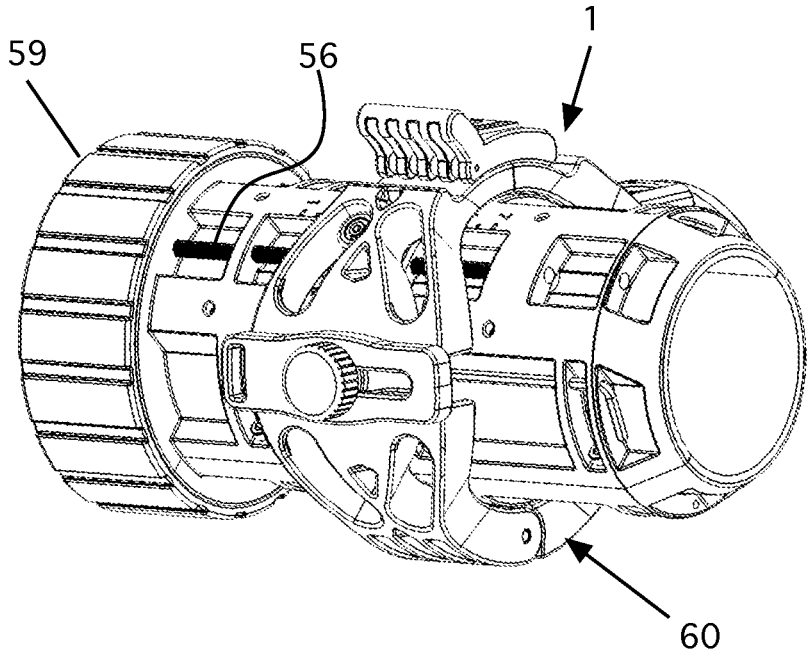
FIG. 24 is a perspective view of the lock side of the bolted sleeve collar and oarlock assembly.

FIG. 24 is a perspective view of the lock side of the threaded sleeve collar 59 and oarlock assembly 1 mounted on the sleeve. Note the placement of the threaded rod 56.

Figure 25:
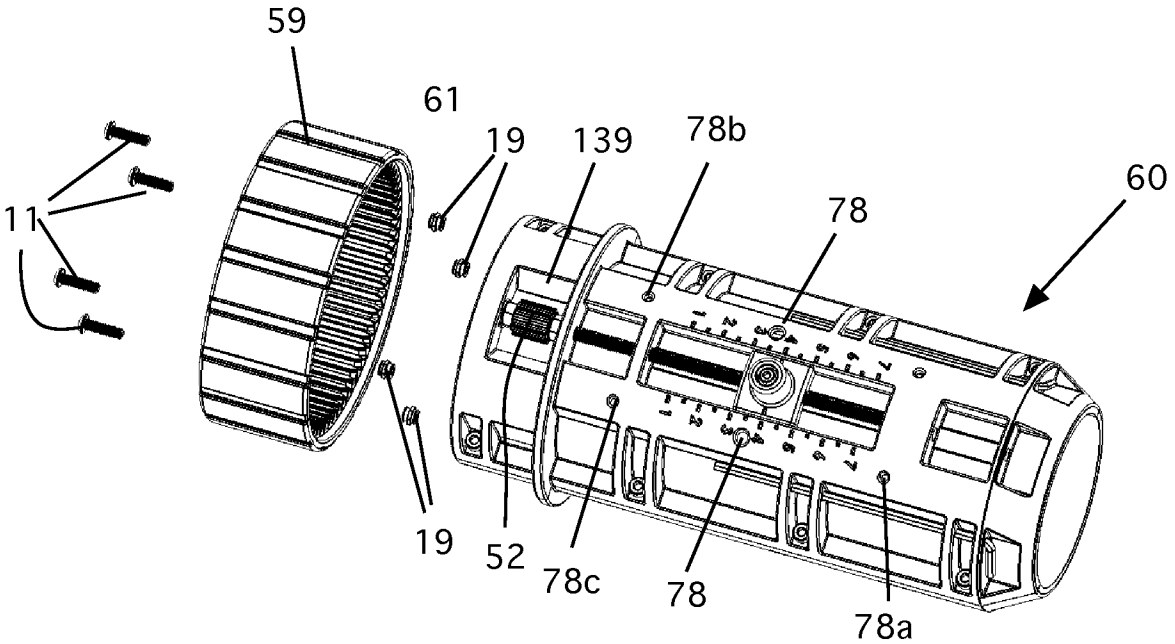
FIG. 25 is an exploded top view of the bolted sleeve collar assembly.

FIG. 25 is a partially exploded top view of the threaded sleeve collar assembly. In this view, the assembled sleeves 60 are shown as in FIG. 21. Note there are center epoxy fill holes 78 shown on sleeve 51. There are also end vent holes 78*a* as shown. The use of these holes is discussed below. Note the spur gear 52 is shown. The collar 59 is shown with fasteners 11 and threaded inserts 19 as well. Note that a gear assembly cavity 138 is formed in the assembled sleeves 60 for access to the spur gear 52, as discussed below. Note too, that inside of the collar is a ring gear 61. The purpose of the ring gear and spur gear is to adjust the inboard, as described below.

Figure 26:
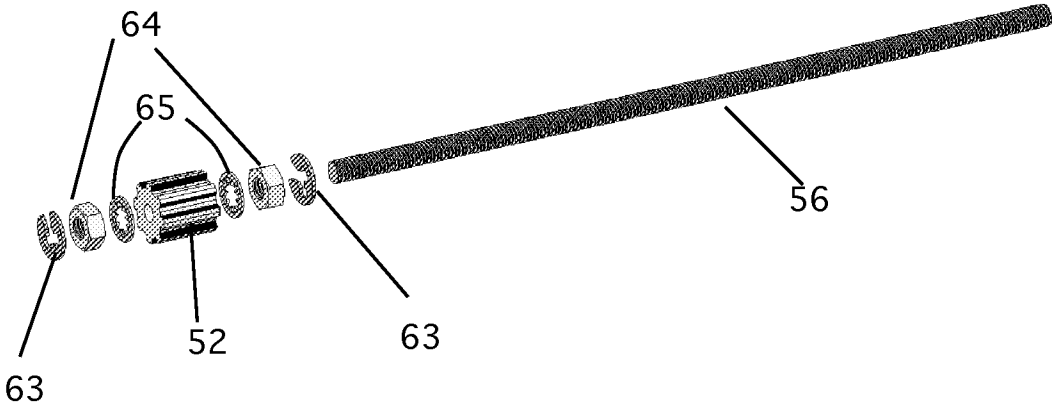
FIG. 26 is an exploded top view of the sleeve spur gear assembly.
Figure 27:
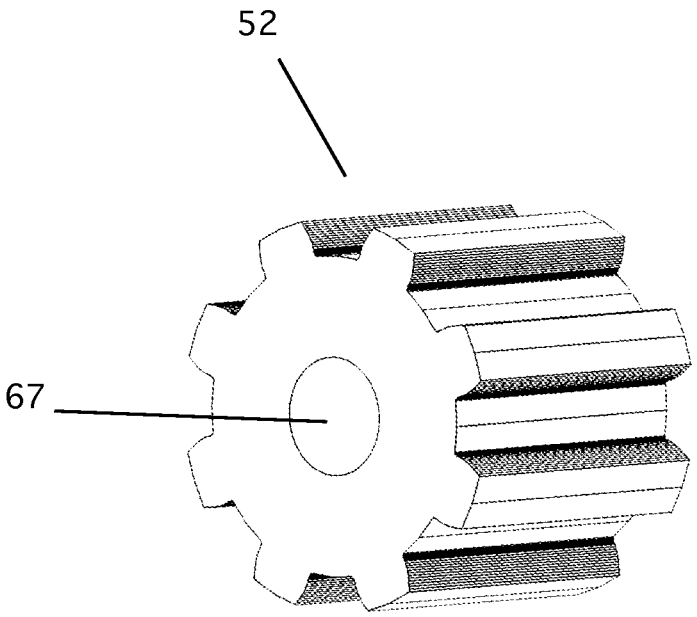
FIG. 27 is a perspective view of the sleeve spur gear.

FIG. 26 is an exploded perspective view of the threaded sleeve spur gear assembly. Here, The threaded rod 56 is shown with the spur gear 52. In the preferred embodiment, the spur gear is attached to the threaded rod 56 using a pair of split ring spacers 63, a pair of lock washers 65, and a pair of lock nuts 64. FIG. 27 is a perspective view of the threaded sleeve spur gear 52. The spur gear has a center hole 67 that the threaded rod passes through, and gear teeth 68 as shown.

Figure 28:
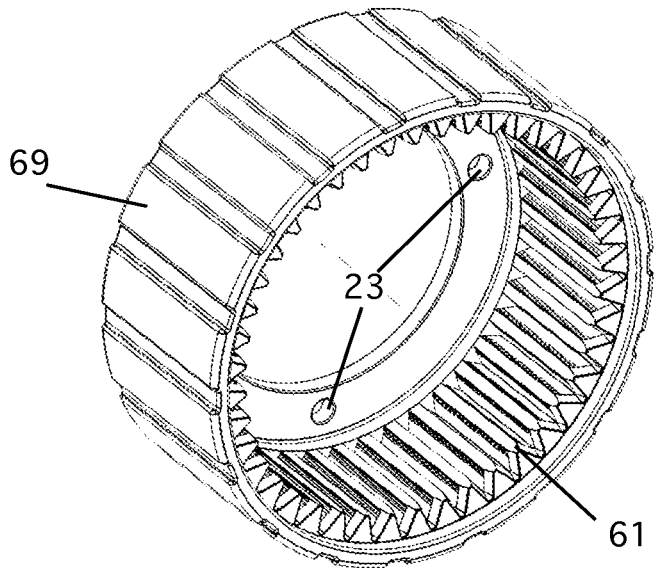
FIG. 28 is a perspective view of the collar for the threaded sleeve

FIG. 28 is a perspective inside view of the threaded sleeve collar 59 used with the threaded sleeve (see e.g., FIG. 25). The collar 59 has a knurled handgrip portion 69 on the outer surface of the collar. This view also shows the holes 23 for the fasteners (see FIG. 25). Note that this view also shows a portion of the ring gear 61.

Figure 29:
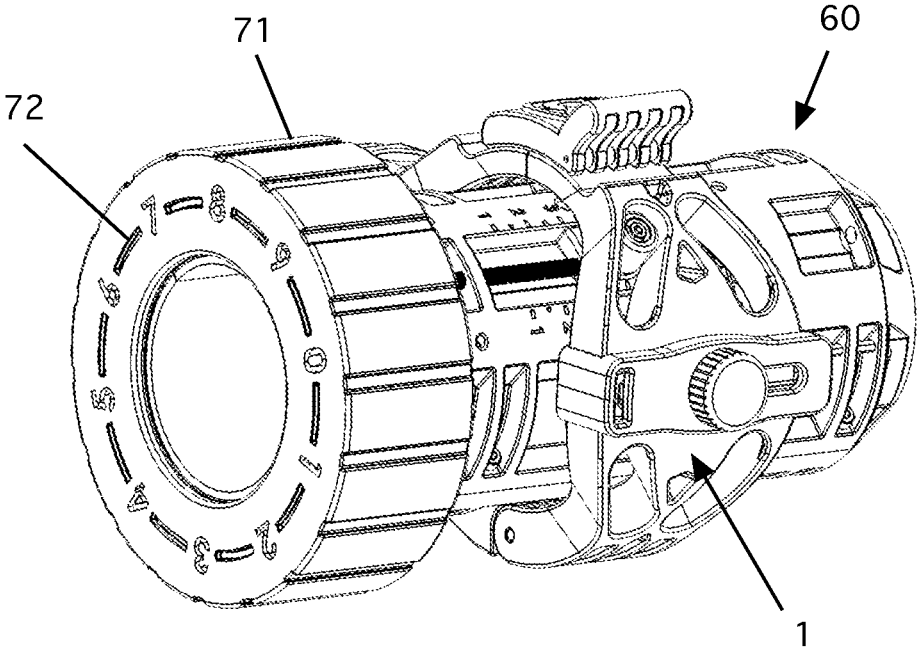
FIG. 29 is a perspective view of the lock side of the threaded sleeve with collar (retained) and oarlock assembly.
Figure 30:
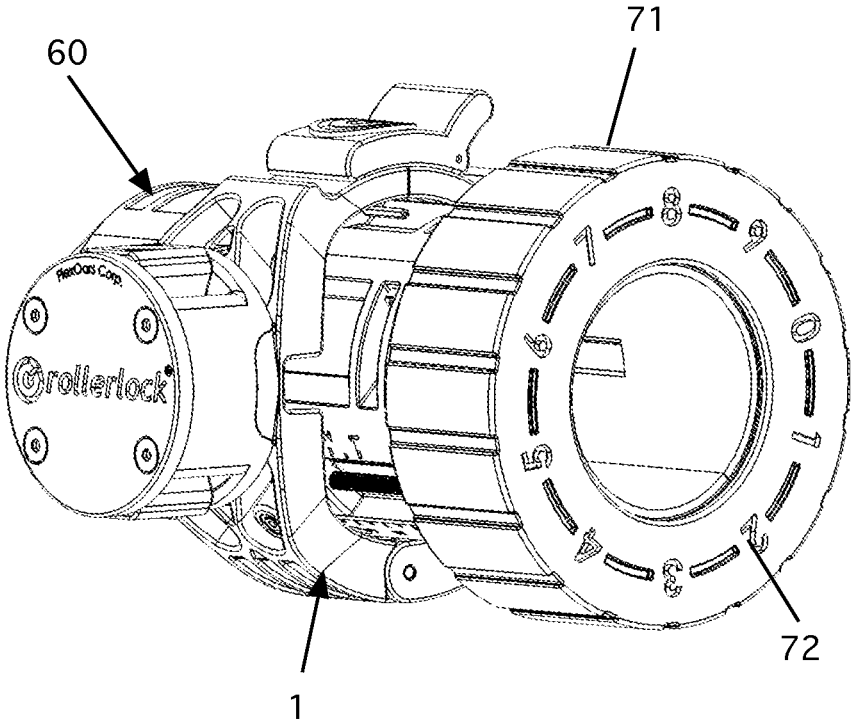
FIG. 30 is a perspective view of the pin side of the threaded sleeve with the retained collar and oarlock assembly.

FIG. 29 is a perspective view of the lock side of the assembled sleeves 60 with the oarlock assembly 1 attached and the collar 59 attached. FIG. 30 is a perspective view of the pin side of the same assembly. Note that these views show the outer surface of the collar 59 that the fine inboard adjustment indicator 72 imprinted on it. The use of this indicator is discussed below.

Figure 31:
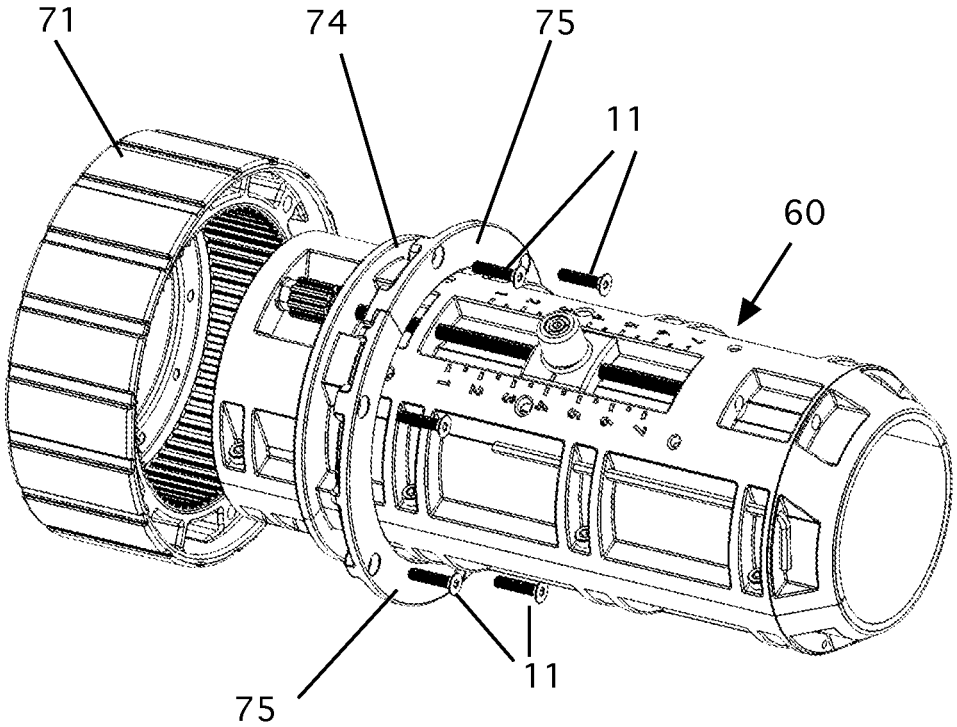
FIG. 31 is an exploded view of the threaded sleeve and retained collar assembly.

FIG. 31 is a partially exploded view of the threaded sleeve and retained collar assembly with the collar 59 shown removed from the assembled sleeves 60. The collar 59 is held on the sleeve with a retaining ring 75. The retaining ring 75 has a mating surface 74 that engages the collar 59 and holds it in position. Fasteners 11 are used to secure the retaining ring to the collar.

Figure 32:
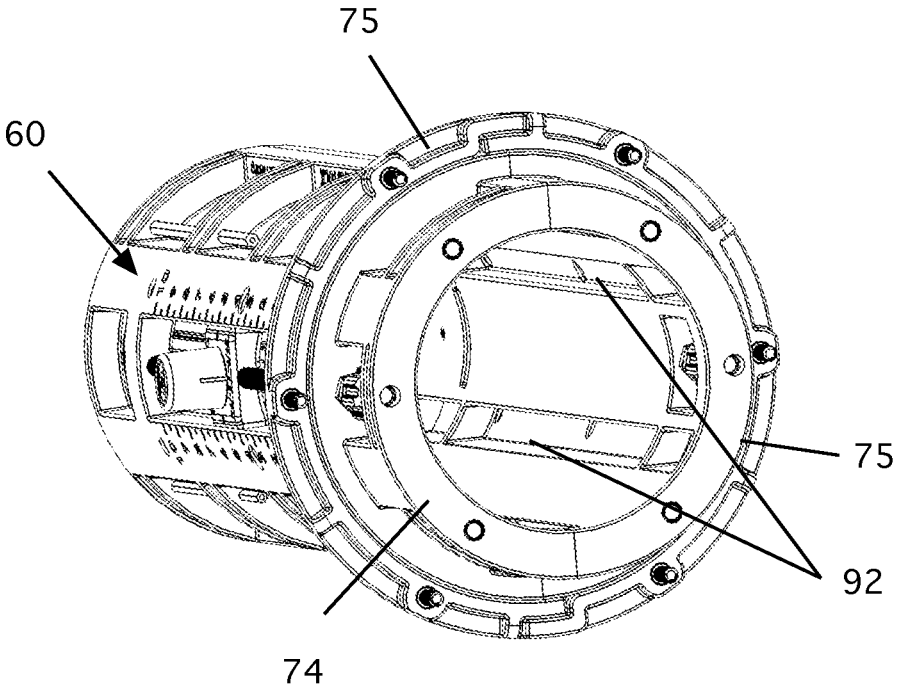
FIG. 32 is a perspective view of the threaded sleeve assembly without the retained collar.

FIG. 32 is a perspective view of the threaded sleeve assembly without the retained collar. In this view, the front of the retaining ring 75 is shown. The mating surface 74 is shown. Note also, this view shows epoxy channels 92 in the interior of the assembled sleeves 60. These channels and the use of epoxy are discussed below.

Figure 33:
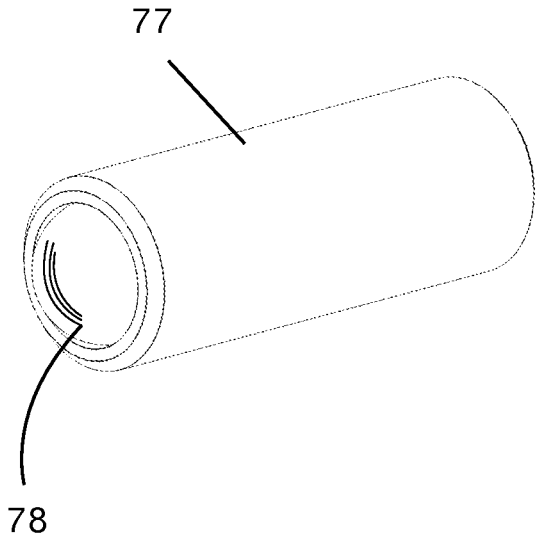
FIG. 33 is a perspective view of the indexer for the threaded sleeve with the spring-loaded indexer.
Figure 34:
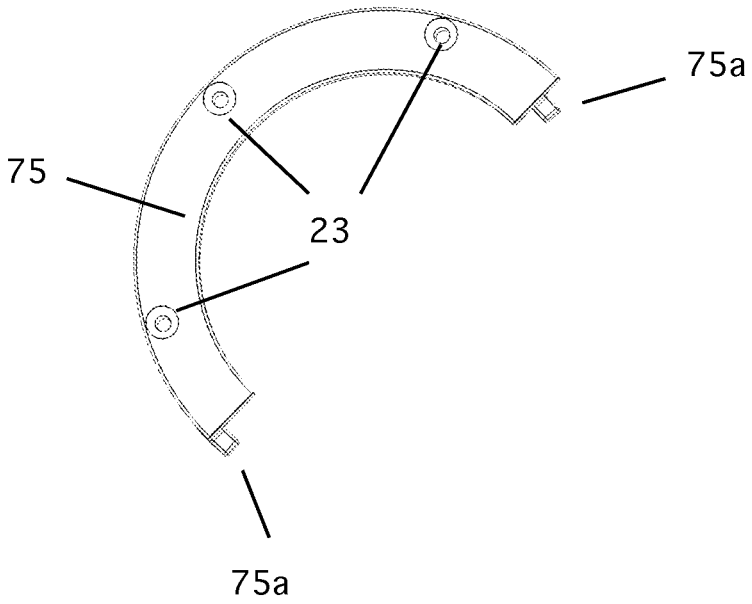
FIG. 34 is a front view of the retainer for the threaded sleeve with the retained collar

FIG. 33 is a perspective view of the spring-loaded indexer 77 used with the threaded sleeve assembly. The spring-loaded indexer 77 is a tube that has a spring inside of it (not shown) and a ball 78 that is placed within the tube. The spring biases the ball 78 is that it protrudes from the end of the tube 77. Although one spring-loaded indexer 77 is shown, four spring loaded indexers that are pressed into the four holes on the handle end of the sleeve in the retained collar assembly as shown in FIG. 32. These spring loaded indexers work alternatively drop into ten indentations on the inside of the retained collar 71. FIG. 34 is a front view of one-half of the retaining ring 75 used with the threaded sleeve system. In the preferred embodiment, the retaining ring 75 is split into two halves as shown. Tabs 75*a* are used to align and connect the two halves. Note too that the fastener holes 23 are also shown.

Figure 35:
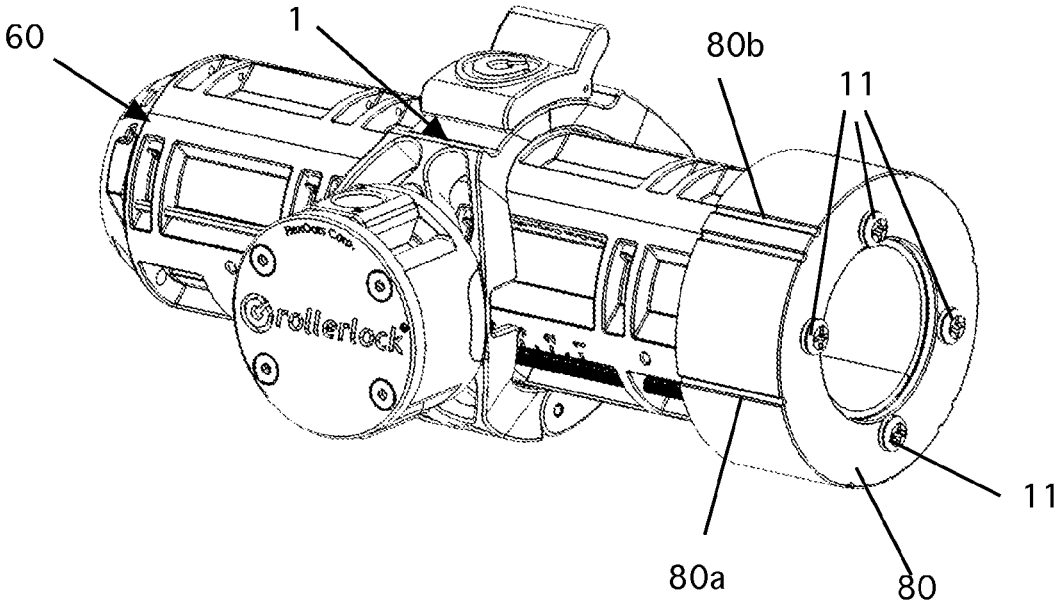
FIG. 35 is a perspective view of the pin side of the threaded sleeve with end cap and oarlock assembly.
Figure 36:
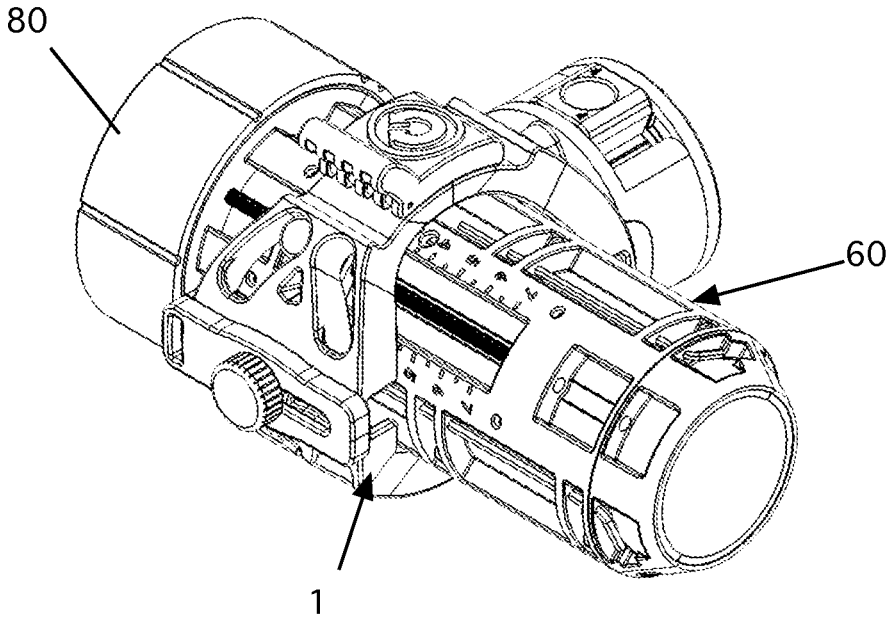
FIG. 36 is a perspective view of the lock side of the threaded sleeve with the end cap and oarlock assembly.

FIG. 35 is a perspective view of the pin side of the threaded sleeve with end cap and oarlock assembly. FIG. 36 is a perspective view of the lock side of the threaded sleeve with the end cap and oarlock assembly. These two figures show the same assembled sleeve 60 with the oarlock 1 attached as before. The difference is in the end cap 80, which is secured to the sleeve with fasteners 11 as shown. As shown if FIG. 35, the outer face of the cap 80 has a number of grooves 80*a* that correspond to a series of ribs 80*b* that extend into the cap (see, FIG. 37).

Figure 37:
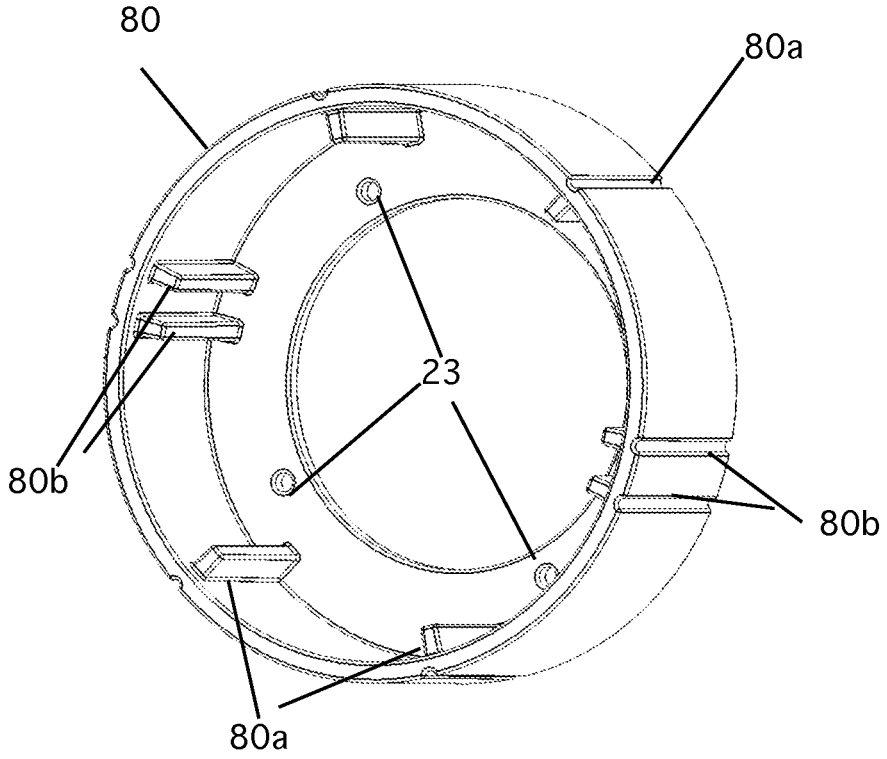
FIG. 37 is a perspective view of the end cap for the threaded sleeve with end cap.

FIG. 37 is a perspective view of the interior of the end cap 80 here, the ribs 80*b* that correspond to the grooves 80*a* in the outer surface of the cap. Holes 23 are holes for the fasteners 11 to attach the cap to the assembled sleeves 60. This is a bolt on cap that is used with the manual adjustment method as discussed below. It is not used to change the inboard, but must be removed to allow access so the cam blocks can be moved manually.

Figure 38:
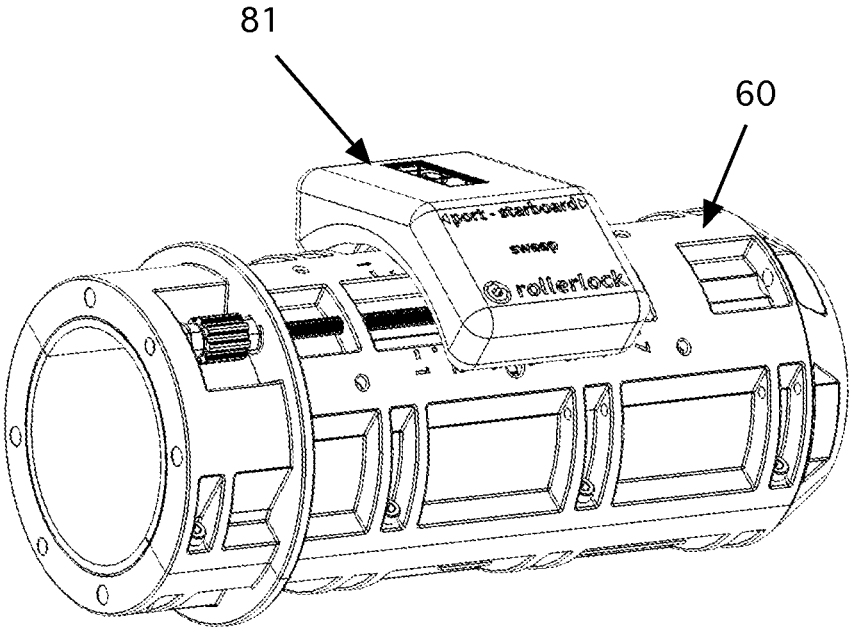
FIG. 38 is a perspective view of the sleeve with the pitch tool assembly.

FIG. 38 is a perspective view of the sleeve with the pitch tool assembly 81. The pitch tool assembly is attached to the pair of assembled sleeves as shown. As discussed below, it is designed to allow a user to adjust the pitch of the oars quickly and easily. While the use of the pitch tool is discussed below, a discussion of the parts of this tool follows.

Figure 39:
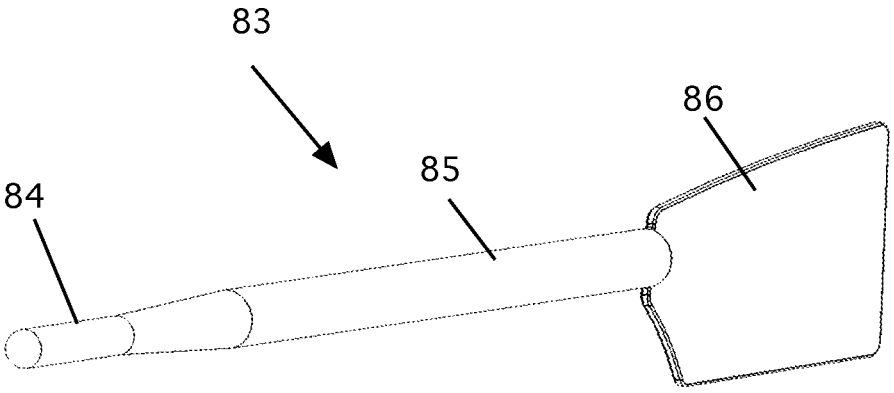
FIG. 39 is a perspective view of the oar assembly.

FIG. 39 is a perspective view of a typical oar 83. The oar has a handle 84, a shaft 85 and a blade 86.

Figure 40:
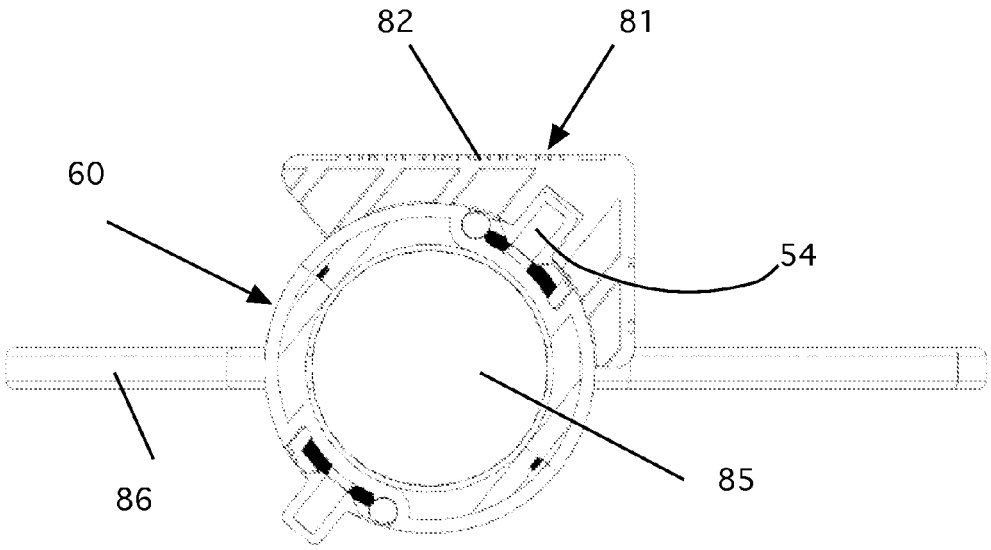
FIG. 40 is a cross-sectional view of the oar, sleeve and pitch tool assembly.

FIG. 40 is a cross-sectional view of the sleeve and pitch tool assembly. In this view, the sleeves 60 are attached to the oar shaft 85. The view is looking down the shaft of the oar with the blade 86 being visible. Note that the pitch tool 81 is shown attached to the assembled sleeves 60 such that a cavity 82 formed in the pitch tool 81 is positioned over one of the cam blocks 54.

Figure 41:
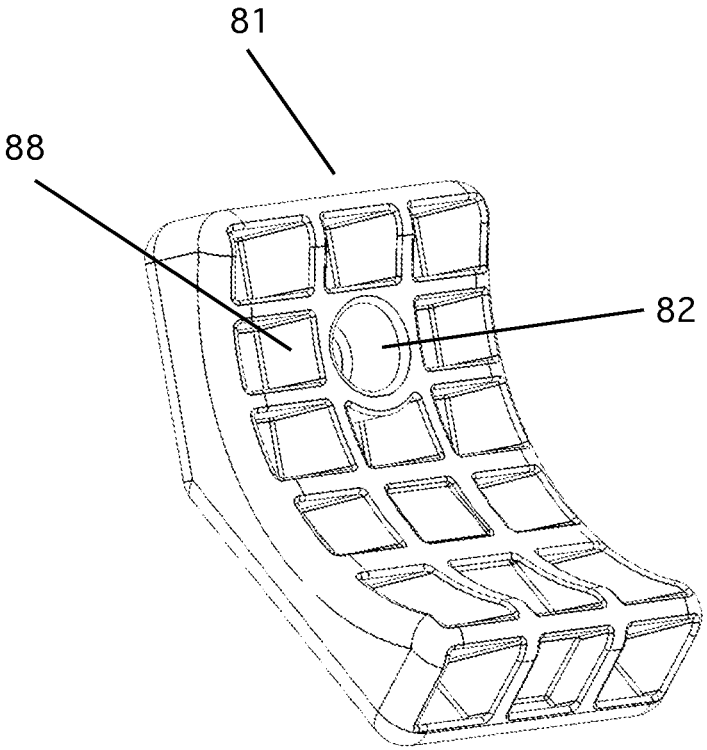
FIG. 41 is a bottom perspective view of the pitch tool.

FIG. 41 is a bottom perspective view of the pitch tool 81. As shown, the pitch tool has a number of ribs 88 formed in it. It also has a cavity or cylinder 82 for the cam blocks, as discussed above.

Figure 42:
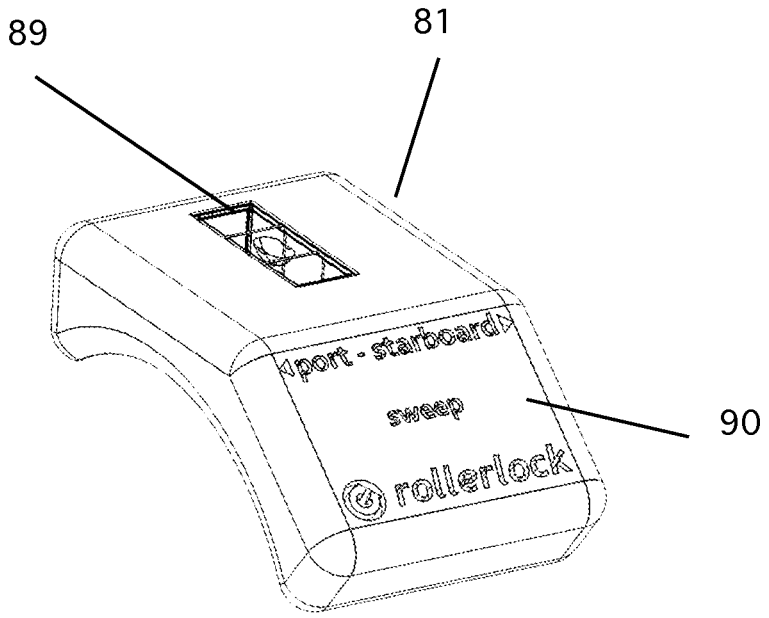
FIG. 42 is a top perspective view of the pitch tool.

FIG. 42 is a top perspective view of the pitch tool. Here, other components of the pitch tool 81 are shown. At the top of the tool is a spirit level 89 and on the angle face 81*a* are markings 90 for port and starboard. The use of these features is discussed below.

Figure 43:
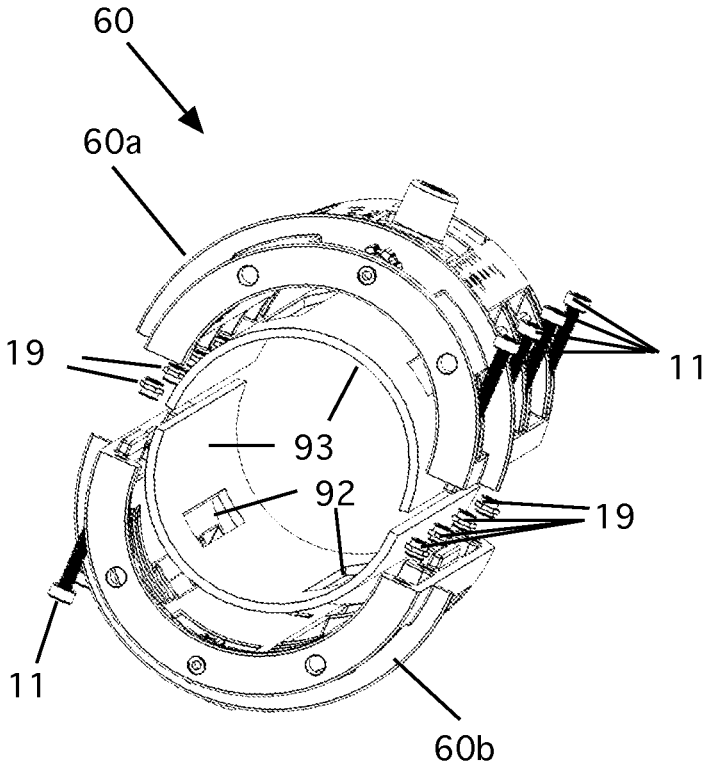
FIG. 43 is a perspective view of the sleeve halves and spacer pads assembly.

As discussed above, in the preferred embodiment, the sleeve assembly 60 is made up of two sleeves that are fastened together around an oar shaft. FIG. 43 is a perspective view of the sleeve halves 60*a* and 60*b*. Within the sleeves is a set of spacer pads 93 that are used to ensure a tight fit over various diameters of oar shafts. Note that the sleeves 60*a* and 60*b* are formed with epoxy channels 92 that are used to accept epoxy, as discussed below. Note also fasteners 11 and threaded inserts 19 used to connect the sleeves 60*a* and 60*b* together.

Figure 44:
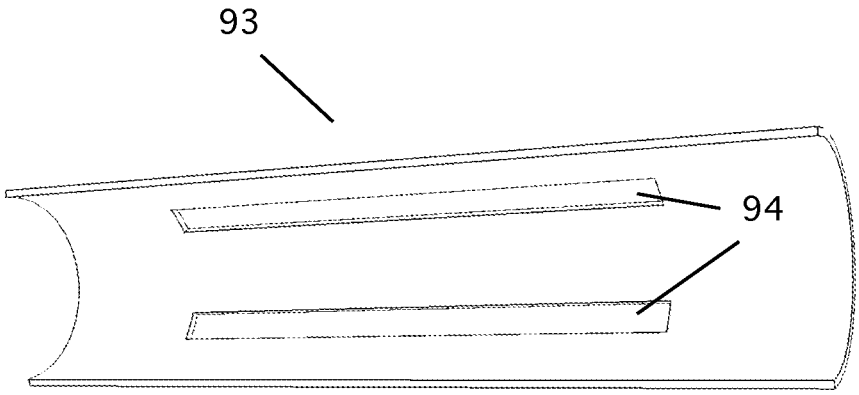
FIG. 44 is a perspective view of the spacer pads.

FIG. 44 is a perspective view of a spacer pad 93. Note that each pad has a large rectangular cutout that acts as an epoxy channel 94 that is formed in each pad.

Figure 45:
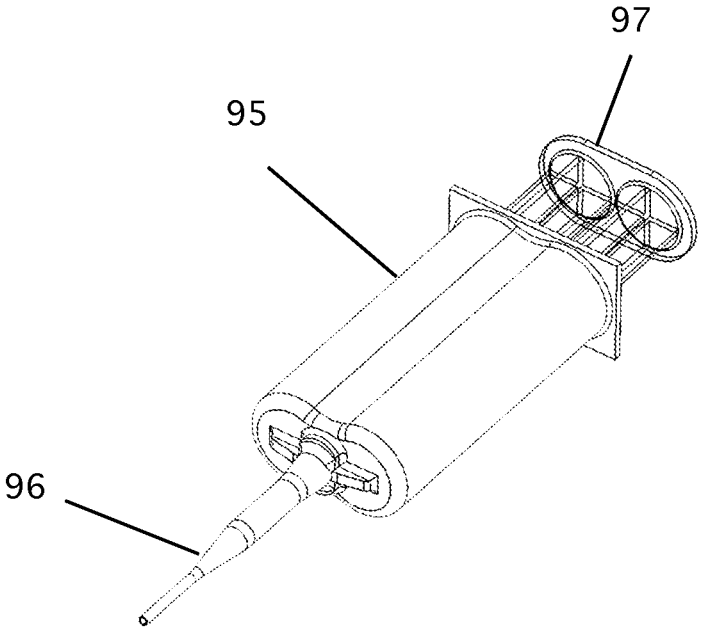
FIG. 45 is a perspective view of the epoxy dispenser.

FIG. 45 is a perspective view of a typical two-part epoxy dispenser 95. This type of dispenser has an applicator tip 96 and a plunger system 97.

As discussed above, one of the features of the invention is the use of cam blocks 54, which are installed in the sleeves 60*a* and 60*b*. The next set of figures details these cam blocks, how they are assembled, and how they are installed in the sleeves.

Figure 46:
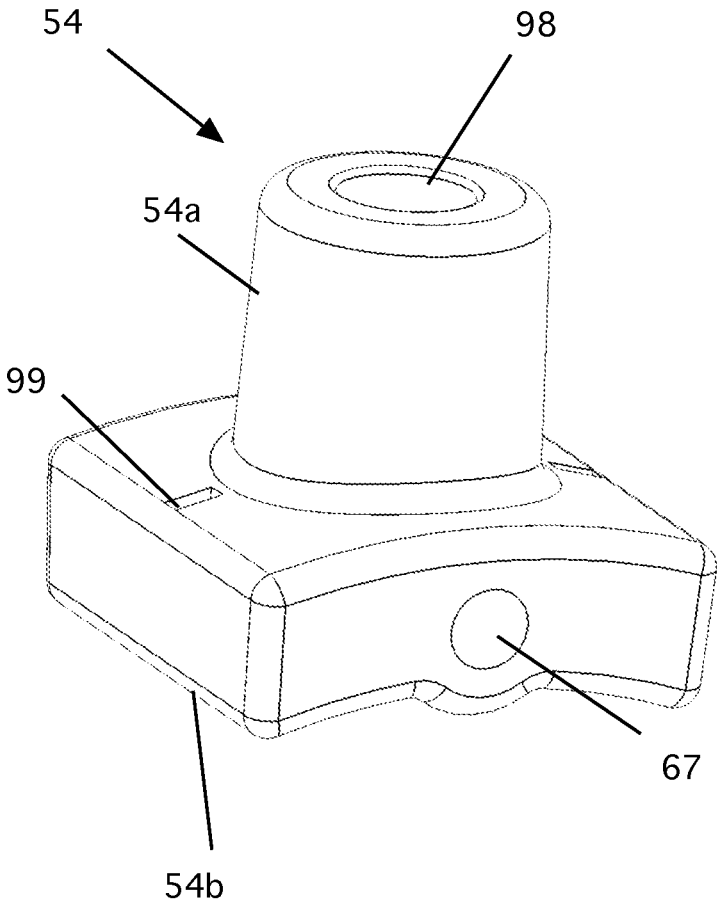
FIG. 46 is a perspective view of the one-piece threaded cam block

FIG. 46 is a perspective view of the one-piece threaded cam block 54. The first embodiment of cam blocks 54 has a cam portion 54*a* and a slider portion 54*b*. The cam portion 54*a* extends upward from the slider portion as shown and has a center cylindrical cavity formed in it to receive a magnet 98. The slider portion 54*b* has a threaded hole 67 for receiving the threaded rod 56 (see FIG. 56). On the upper face of the slider portion 54*b* and at a right angle to the threaded hole 67, is an inboard adjustment indicator 99. This is used to mark the inboard at any given position.

Figure 47:
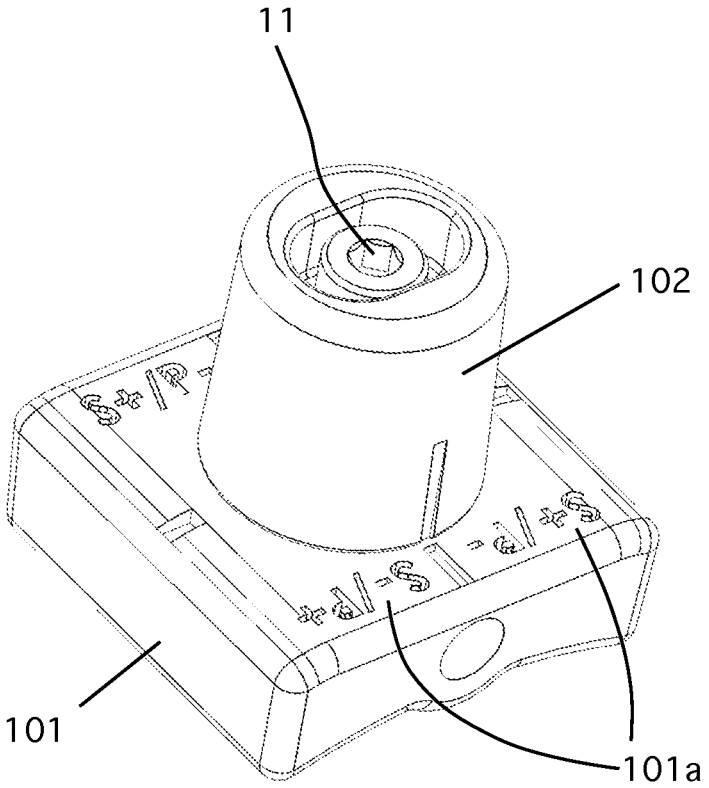
FIG. 47 is a perspective view of the threaded cam block with adjustable pitch assembly.
Figure 48:
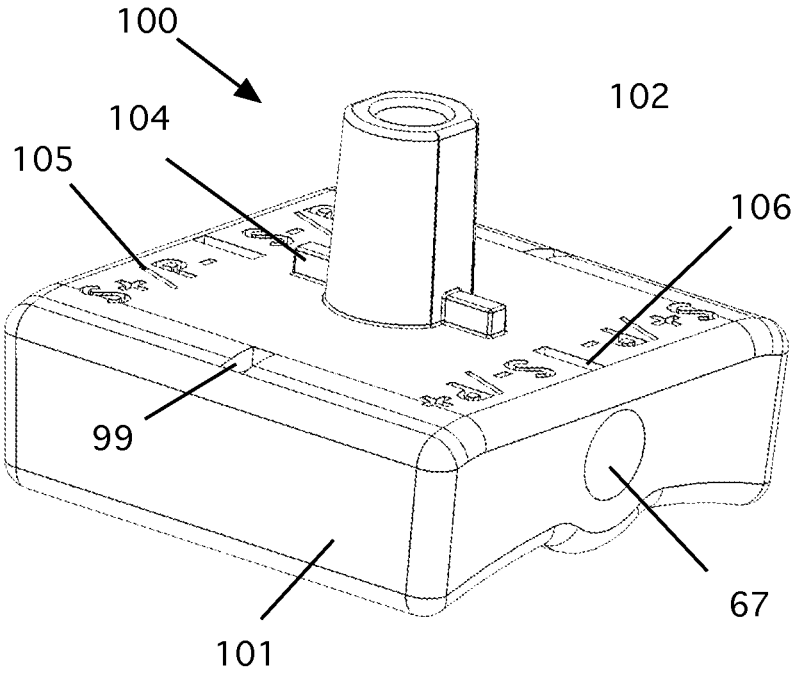
FIG. 48 is a perspective view of the threaded cam block with an adjustable pitch base.

FIG. 47 is a perspective view of a second embodiment of cam block 100 that has an adjustable pitch assembly. Here, the cam portion or barrel 102 is placed on the slider portion 101. In this embodiment, the barrel is open at the top has a fastener 11 installed. Note that the slider portion has indicators 101*a* that indicate adjustments starboard or port, as discussed in the operating section below. FIG. 48 is a perspective view of the cam block 100 with an adjustable pitch base. In this view, the block 100 has the threaded cam portion or barrel 102. Here, a locking tongue 104 is shown in place. This tongue is used to fix the position of the cam portion or barrel 102, as discussed below. Note too that this figures shows the port/starboard pitch indicators 105 and 106, the use of which is discussed below.

Figure 49:
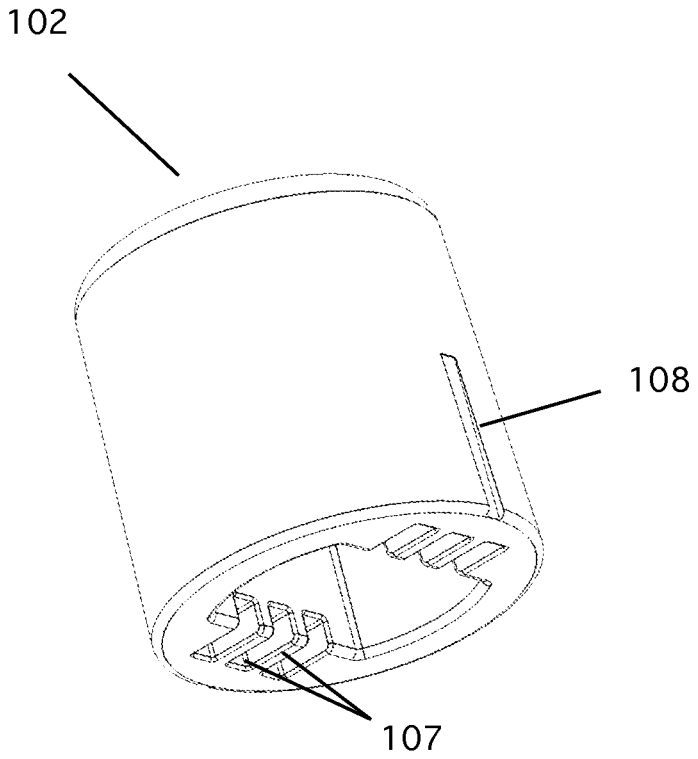
FIG. 49 is a perspective view of the threaded cam block with an adjustable pitch barrel.

FIG. 49 is a perspective view of the threaded cam block with an adjustable pitch barrel. Here, the bottom of the cam portion or barrel 102 is shown. This view shows a number of locking grooves 107 formed on the bottom of the cam portion or barrel 102. Note the blade pitch adjustment indicator 108 is also shown.

Figure 50:
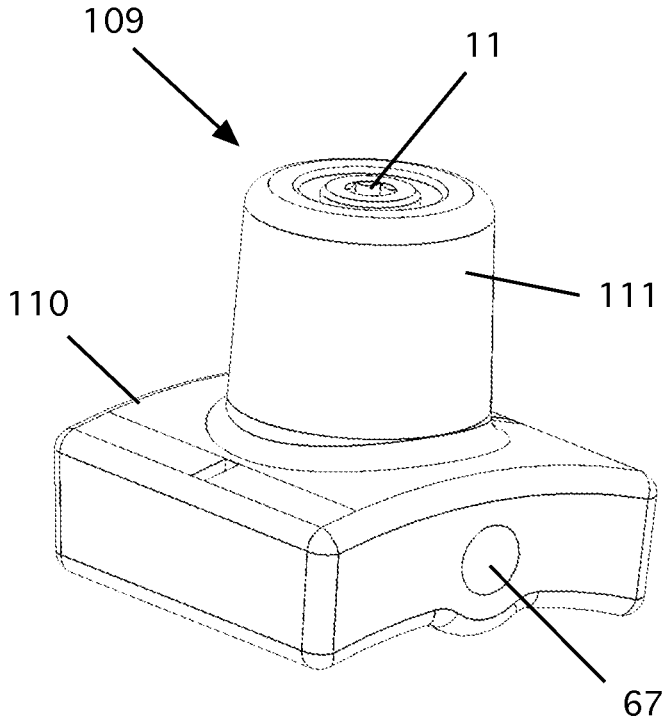
FIG. 50 is a perspective view of the threaded cam block with a bolted roller assembly.
Figure 51:
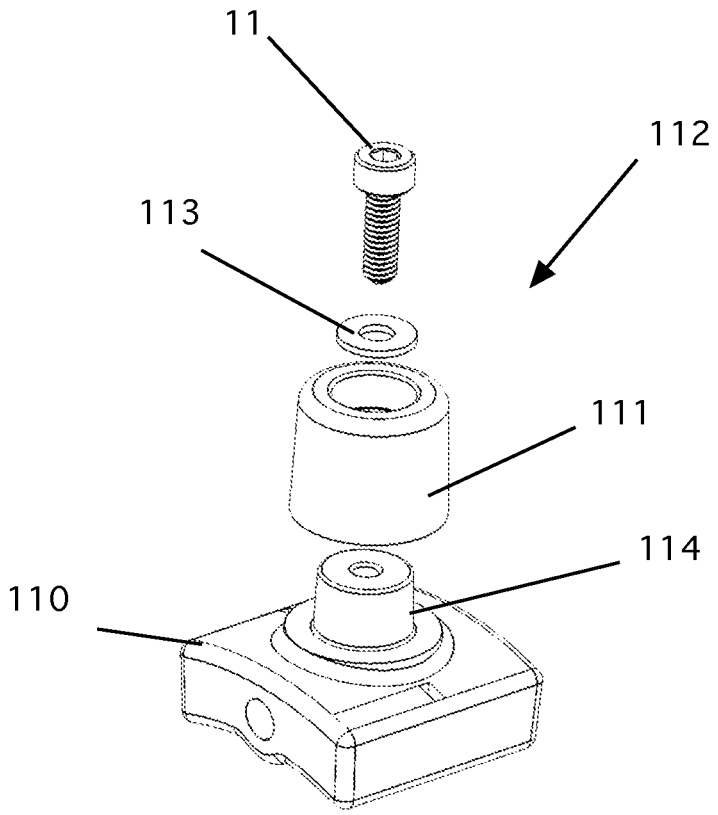
FIG. 51 is an exploded view of the threaded cam block with the bolted roller assembly.

FIG. 50 is a perspective view of the threaded cam block with a bolted roller assembly. As shown, this embodiment of cam block 109 has a bolted roller base 110, a bolted roller barrel or cam portion 111, and a fastener 11. FIG. 51 is an exploded view of the threaded cam block with the bolted roller assembly. Here, the bolted roller base 110, a bolted roller barrel or cam portion 111, and a fastener 11 are shown along with a washer 113 and an internally threaded cylinder 114, over with the barrel or cam portion 111 is positioned. The barrel or cam portion 111 is then secured with the fastener 11, which engages the threaded cylinder 114.

Figure 52:
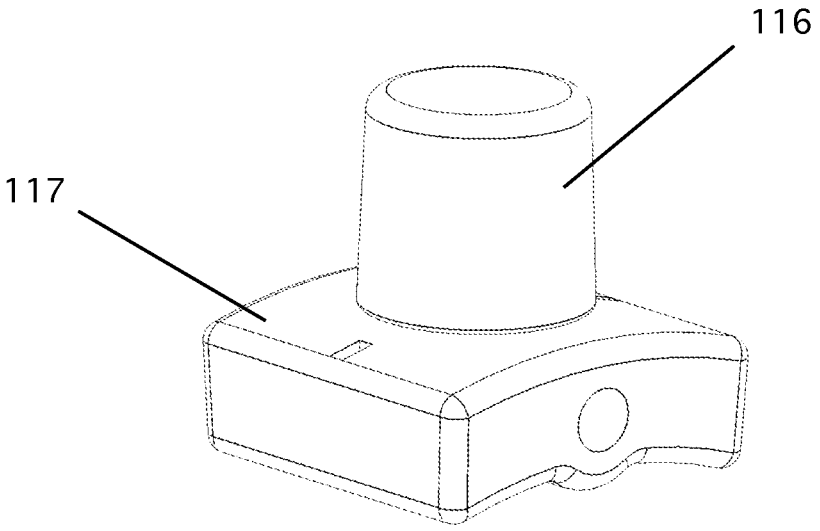
FIG. 52 is a perspective view of the threaded cam block with a snap-on roller assembly.
Figure 53:
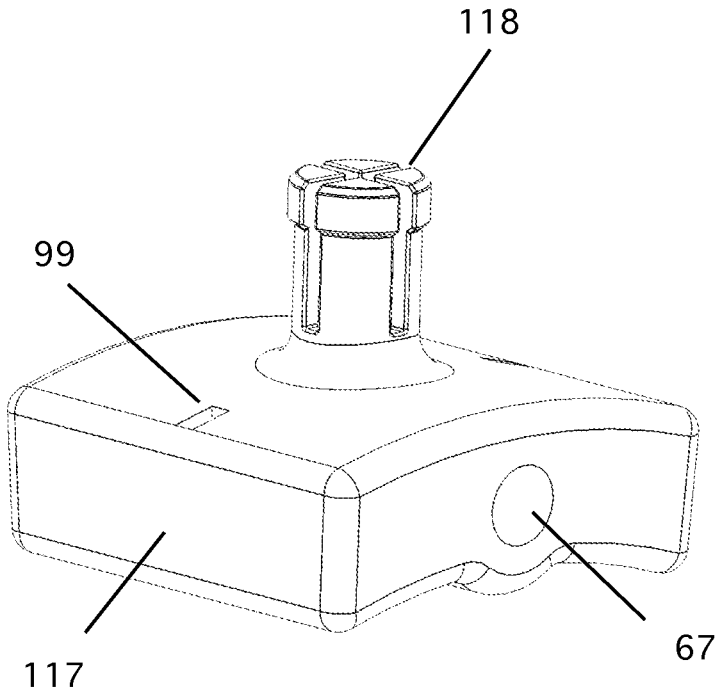
FIG. 53 is a perspective view of the threaded cam block with snap-on roller base.

FIG. 52 is a perspective view of the threaded cam block with a snap-on roller assembly 115. FIG. 53 is a perspective view of the threaded cam block with snap-on roller base. In this embodiment, there is a barrel or cam portion 116 that snaps onto the snap-on stem 118, which is formed on the base 117, as shown.

Figure 54:
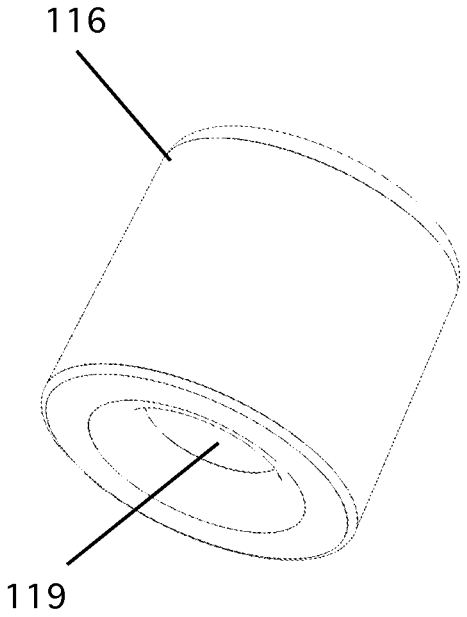
FIG. 54 is a perspective view of the threaded cam block with the snap-on roller barrel.

FIG. 54 is a perspective view of the threaded cam block with the snap-on roller barrel 116. In this view, the bottom of the barrel or cam portion 116 shows the inside cylinder 119 that engages the snap-on stem 118.

Other embodiments of the sleeve system are possible. FIGS. 55-60 show three different variations.

Figure 55:
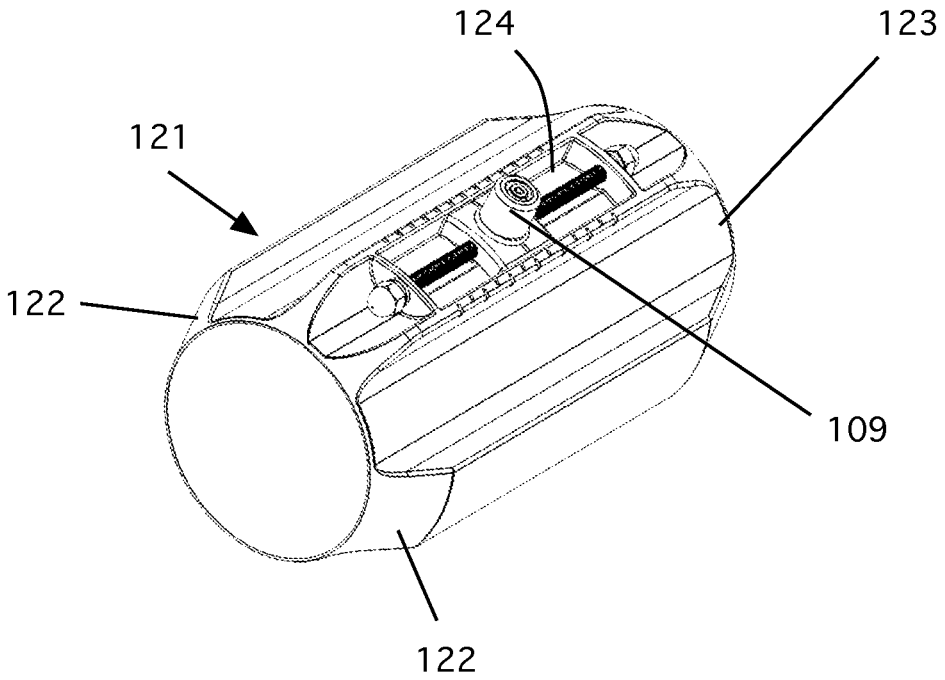
FIG. 55 is a perspective view of the one-piece sleeve with cam blocks assembly.
Figure 56:
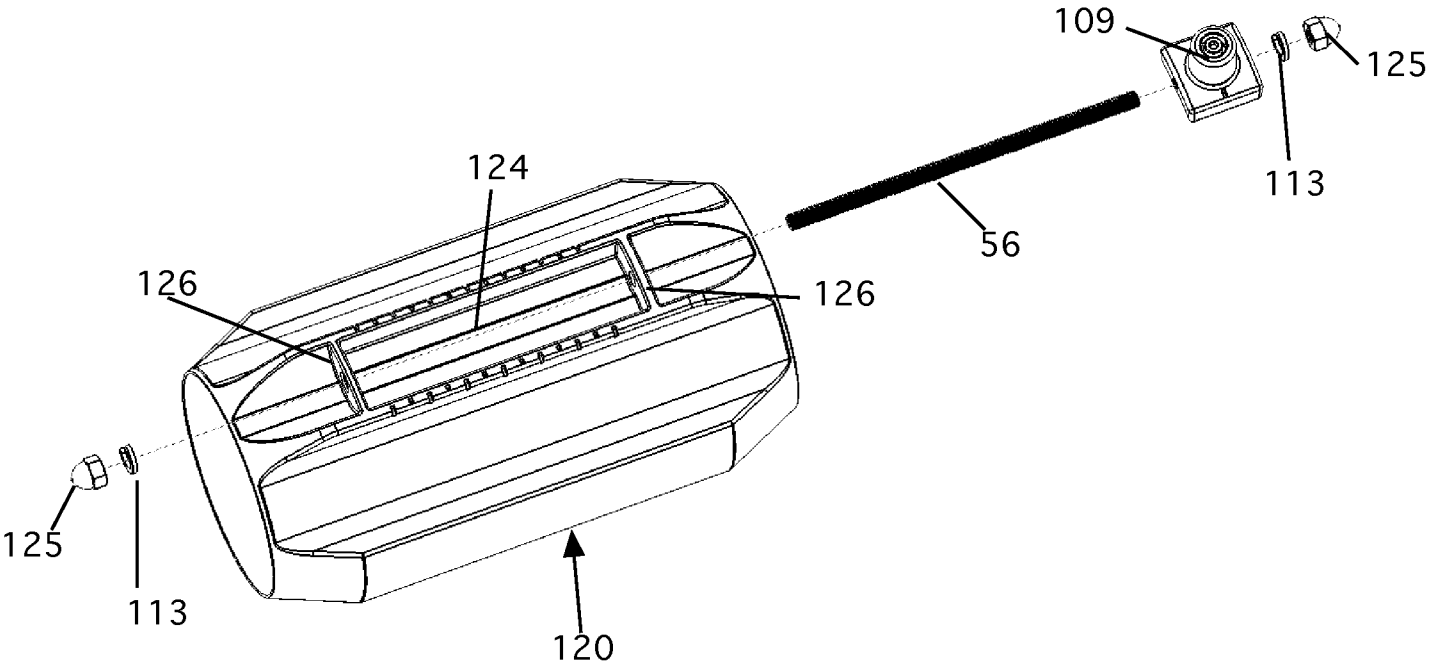
FIG. 56 is an exploded view of the one-piece sleeve with threaded cam blocks assembly.

FIG. 55 is a perspective view of the one-piece sleeve with cam blocks assembly 120. This assembly has a one-piece sleeve 121 that has raised sleeve sections 121 and lower sleeve sections 123 as shown. The sleeve 121 has an inboard adjustment channel 124 that houses a threaded cam block as shown FIG. 56 is an exploded view of the one-piece sleeve with threaded cam blocks assembly. This view shows has a one-piece sleeve 121 and inboard adjustment channel 124. The sleeve has two brackets 126 that support the threaded rod 56. The can block 109 is placed between the brackets 126 and the threaded rod is slid into one of the brackets 126, where the threaded rod contacts the cam block 109. The rod is threaded through the cam block through the threaded hole 67 (see FIG. 50). The threaded rod then passes through the second bracket 126. It is secured using washers 113 and acorn nuts 125.

Figure 57:
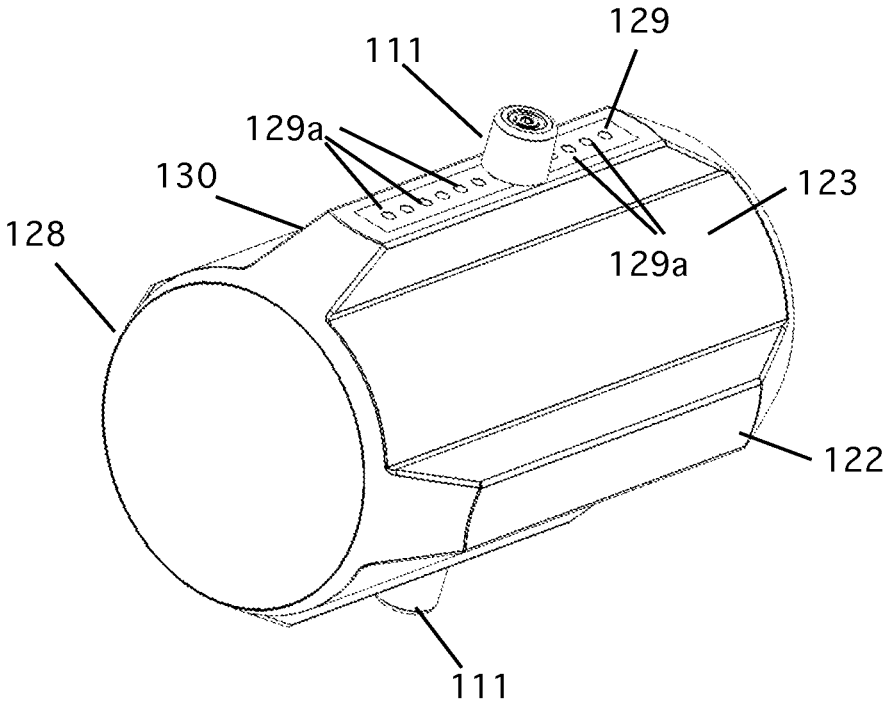
FIG. 57 is a perspective view of the one-piece sleeve with bolted cam blocks assembly.
Figure 58:
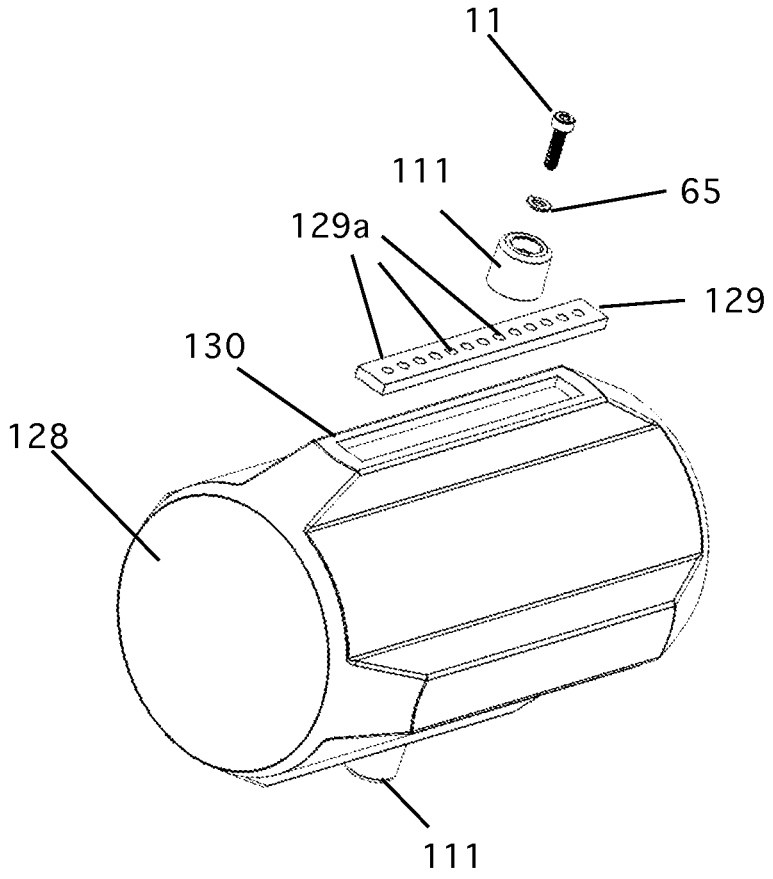
FIG. 58 is an exploded view of the one-piece sleeve with bolted cam blocks assembly.

FIG. 57 is a perspective view of the one-piece sleeve with bolted cam blocks assembly FIG. 58 is an exploded view of the one-piece sleeve with bolted cam blocks assembly. Here, a sleeve 128 is shown. This sleeve has raised and lower sleeve section 122 and 123 respectively. This sleeve has an inboard adjustment bar cavity 130 formed in it that received the inboard adjustment bar 129. This bar has a number of tapped holes 131 that a bolted roller barrel 111 is screwed. Note that there are two inboard adjustment bars 129 on the sleeve. The figure shows a second bolted roller barrel 111 extending down from the bottom of the sleeve.

Figure 59:
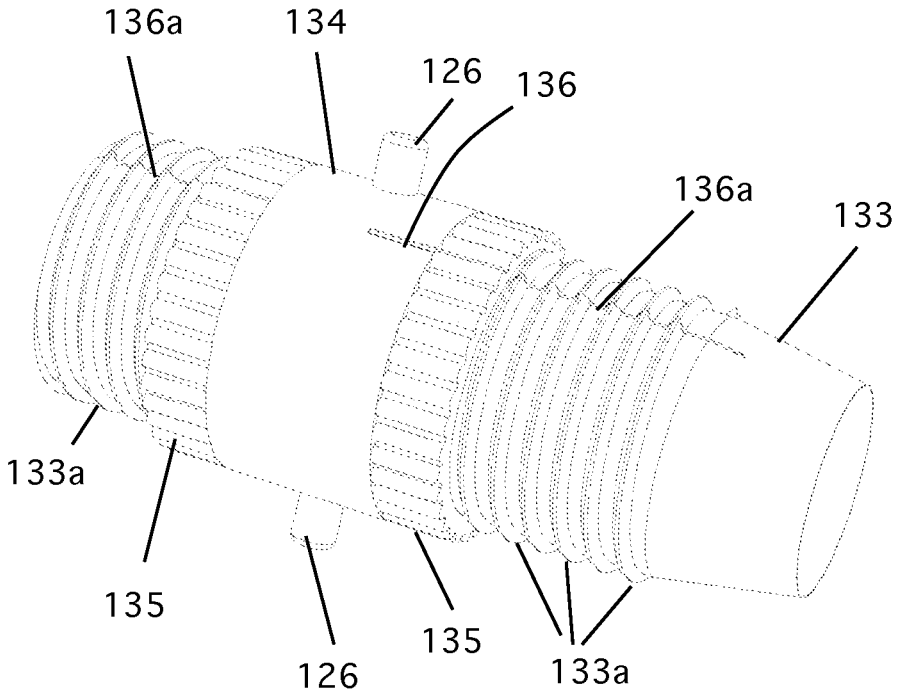
FIG. 59 is a perspective view of the one-piece sleeve with ring cam block assembly.
Figure 60:
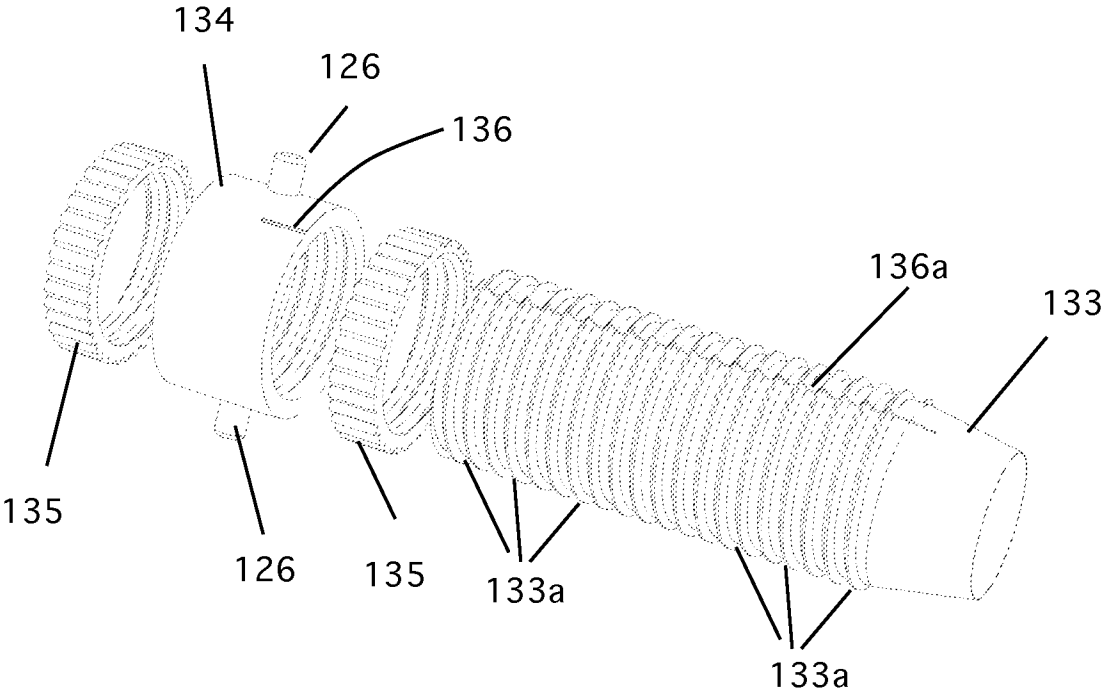
FIG. 60 is an exploded view of the one-piece sleeve with ring cam block assembly.

FIG. 59 is a perspective view of the one-piece sleeve with ring cam block assembly. FIG. 60 is an exploded view of the one-piece sleeve with ring cam block assembly. This final embodiment of sleeve assembly 132 has a sleeve cylinder 133 that has a number of formed threads 133*a*, a cam block ring 134 that is screwed onto the sleeve and is secured using locking rings 135. Note the two cam blocks 126 extending outward from the cam block ring 134. Note also the 180-degree blade pitch indicator 136 that is formed on the cam block ring 134.

As noted above, the invention uses a new oarlock design in combination with different embodiments of a new sleeve system to produce a system that makes adjusting pitch and inboard relatively simple. Moreover, the system provides secure set-up where, despite use, the settings remain stable over time. The structure of these components has been described above. Their use is discussed below:

The oarlock and pitch adjustments

The pitch of an oar is one of the parameters that rowers must set and monitor.

As described above, the blade pitch is the angle of inclination of the blade to the vertical during the propulsive phase of the stroke. Moreover, sometimes even accomplished rowers fail to keep the blade at the optimal depth during the drive portion of the stroke. When the blade comes up too high or dives too deeply, energy and power is lost, leading to a reduction in speed and destabilizing the shell. One of the worst-case scenarios is when the blade dives so deep that it cannot be extracted at the end of the stroke. This phenomenon, called "catching a crab," can result in losing a race, breaking equipment, or even ejecting and injuring the rower.

The current state of the art provides the ability to adjust only blade pitch with pitch bushings in the oarlock, but not blade depth. Oarlocks currently in use for competition offer four 4 different pitch bushings to change blade pitch: 7/1, 6/2, 5/3 and 4/4. Depending on how these bushings are oriented, they offer a range of adjustability from 3 degrees negative pitch to 3 degrees positive pitch. They are also sized to custom fit the various oar pin 13 sizes. To adjust this pitch, pitch gauges have been developed. Most pitch gauges rely on the flat vertical surface inside the traditional oarlock, and will not work with a circular design of the instant invention, as discussed above.

To solve this problem, one of the features of the present design is the flat vertical surface to serve this purpose. That surface is the outside of the cap 6 in FIGS. 1 and 4. Pitch gauges resting on this surface measure zero pitch, rather than 4 degrees for oarlocks typically in use today. Rather than pitch the oarlock at 4+ degrees, the present invention pitches the oar/sleeve at 4+ degrees, but the result is the same. This difference needs to be taken into account, however, when using existing pitch tools and computing total pitch at the blade.

The pitch/depth bushings 5 are positioned on the top and bottom of the dual pin disk 21 and between the cap 6 and connector 9 (see FIG. 2). Varying the distance between the depth adjustment sides 37 of the pitch/depth bushings 5 (FIG. 13) and the connector blade angle stops 48 (FIG. 18) changes the degree the oarlock can pivot which in turn controls the oar angle and therefore blade depth. Increase the space between the pitch/depth bushings and connector and blade depth increases. Decrease the space and blade depth decreases. Limiting blade depth can be accomplished in several ways, by increasing the width of the pitch/depth bushings or by reducing the opening in the connector.

The distance between the pitch depth bushings and the connector can be changed in several ways. FIG. 14 shows the preferred embodiment of the pitch/depth bushings. Note that the adhesive spacer pads 42 (FIG. 14) are shown on the angled surfaces of the pitch/depth bushings 5. These pads can be of differing thicknesses depending on the desired limitation oar angle (blade depth). It is also possible to just use a space pad on one side of the pitch/'depth bushing thereby limiting just blade depth and not blade height, or vice versa. Similarly pads of different thicknesses can be used on either side Other methods of controlling blade depth include using pitch depth bushings or connectors with different dimensions or equipped with adjustment screws.

Blade depth can be measured using many external tools such as a specially equipped level or protractor. A more convenient way to measure oar angle is incorporated into the present invention. In FIG. 15 the cap 6 features an oar angle indicator 43. When the oar is perfectly level, the middle of the pitch/depth bushings line up with the zero hash mark. When the oar is tilted one way or the other, the actual oar angle is shown on the cap.

In addition to blade depth, the pitch/depth bushings 5 also help to control blade pitch. As in the current state of the art these parts provide rowers and coaches with the ability to add or subtract up to 3 degrees of pitch to the oarlock. Markings on the pitch/depth bushings follow standard conventions with the following numeric system 4/4=zero additional pitch, 5/3+1 degree, 6/2+2 degrees, 7/1+3 degrees, 3/5, 3/5−1 degree, 2/6−2 degrees, 6/3−3 degrees.

An Improved Method for Setting Correct Blade Pitch

In the current state of the art, sleeves are semi-permanently mounted on oar shafts at the time of manufacture. Depending on the amount of use and care it receives, sleeve might be replaced a few times over the oar's lifetime. The most critical part of this process is to correctly set the pitch of the oar—i.e., the axial position of the sleeve relative to the blade. In the current state of the art this is done using a level across the designated flat surface of the sleeve in conjunction with a simple jig.

However, the sleeves in the present invention (and in my previous oarlock system patent application), are round, not square, so a special pitch tool had to be designed to provide a flat surface for this purpose. The instant invention has a pitch tool 81 (see FIGS. 38, 40 and 41) that provides accurate blade pitch on all three embodiments of sleeves disclosed herein, regardless of the method used to mount or move the cam blocks. The pitch tool 81 is shaped so that it wraps around the sleeve and provides a flat, horizontal and stable platform. Improvements consist of a cavity 82 that fits snugly around the cam block barrel for precise pitching, and an integrated tubular spirit level 89 for convenience. The same pitch tool can be used to pitch both port and starboard oars.

Typical blade pitch is +4 degrees. In the current state of the art this is the result of zero oar pitch and +4 degrees oarlock pitch. The present invention also provides a blade pitch of 4 degrees but does so by pitching the oarlock at zero degrees and the oar at +4 degrees.

A non-adjustable cam block, or an adjustable cam block set to zero, is used to set zero pitch. Other oar pitches however are possible when the adjustable cam block is set to something other than zero.

To pitch an oar with one degree of positive pitch, you need to use the cam block with an adjustable pitch barrel 102 (see FIG. 49), rather than a fixed pitch cam block. There is no need to replace the cam block for the operation. Instead, the adjustable cam block bay in the sleeve 57 (FIG. 21) can be used to temporarily hold the adjustable cam block and pitch tool. Like the pitch tool, the adjustable cam block needs to be oriented via the port—starboard blade pitch indicator 105 (FIG. 48). Set the pitch to −1 degree and then proceed normally with the pitching procedure as described below. The end result will be a +1 pitch on the oar.

Referring now to FIG. 40, the procedure for using the pitch tool to set blade pitch on threaded two-part sleeves is as follows:

Support the end of the blade 86, spoon side down as per the oar manufacturer's instructions Mount sleeve 51 and spacer pads 93 (if needed) loosely around oar shaft 85

Orient the pitch tool according to the port-starboard indicator arrows

Place the pitch tool on top of the sleeve, placing the cam block 54 into cylinder 82.

Rotate the sleeve until bubble in the integrated tubular spirit level 89 is centered (note, an external spirit level or electronic level can also be used).

Tighten the sleeve fasteners 11 keeping the pitch tool on to insure that the sleeve doesn't move.

The present invention is designed so the mechanical grip of the fasteners 11 and threaded inserts 19 is sufficient to hold the sleeve firmly in place on the oar shaft 85. This makes replacement of the sleeves much easier as there is no epoxy to remove. However, as discussed below, the system has been designed to accommodate epoxy, if desired.

For one-piece sleeve designs such as sleeve 121 (FIG. 55) or sleeve 128 (FIG. 57) require a slightly different pitching system. The primary difference is that epoxy is used instead of fasteners 11 to adhere the sleeve 51 to the oar shaft 85.

The method of pitching of the ring sleeve 132 (FIGS. 59-60) is different. The procedure for pitching sleeve 133 is as follows. Referring now to FIG. 59:

Using epoxy, affix the sleeve 133 to the oar shaft 85 (not shown) at the desired inboard setting, without regard to pitch Support the end of the blade 86 (not shown) spoon side down as per the oar manufacturer's instructions.

Orient the pitch tool according to the port-starboard indicator arrows.

Position the pitch tool on top of the can block ring 134.

Insert the cam block 126 into cylinder 82 on the pitch tool 81.

Rotate the cam block ring until bubble on the integrated tubular spirit level 89 is in the center of the level (an external sprit level or electronic level can also be used).

Once the oar is set to the proper pitch, tighten the locking rings 135 on both sides of the cam block ring.

Next, using a ruler and a fine, permanent, waterproof marking pen, draw two longitudinal lines across all threads 133*a* on the sleeve 133 that are in line with the two blade pitch indicators 136 (note, only one is shown because they are 180 degrees apart from each other). Be sure to remove all rings from the sleeve to make sure that each line is drawn unbroken along the entire length of the sleeve. These lines on the sleeve become the permanent reference points for setting proper pitch when the cam block ring 134 is moved to change inboard.

Changing inboard on the one-piece sleeve 133 with the cam block ring 134 is a matter of loosening the locking rings 135 and twisting the cam block ring 134 into a new position, ensuring that the blade pitch indicators 136 are all lined up with the marks previously made on the threads 133*a*. In the preferred embodiment each full twist of the ring 135 increases or decreases inboard by ½ centimeter.

Oar Rotation

In the original oarlock system there are two primary ways of controlling oar rotation. The first is the length of the cam channels in the oarlock, which limits oar rotation to 86 degrees. The second is the shape of the cams that uses the outward pressure of the oar to assist the rower in naturally moving the blade from the catch position (blade vertical), to the feathered position (blade horizontal). This is the mechanical assistance that replaces the function of the flat surfaces of the prior art rowing systems.

In cases where rowers want additional assistance in achieving and holding correct blade position, magnets can be utilized. FIG. 10 shows an outside view pin side half of the oarlock and the hole 110 for a cylindrical magnet. There are corresponding holes in the same position relative to all four cam channels, 25, on both sides of the pin side half of the oarlock 4, and the lock side half of the oarlock, 3, (not shown).

In order to use magnetic assistance for blade positioning, the magnets in the oarlocks must interact with magnets in the cam block. Integrated in the threaded cam block 54, is a corresponding hole 98 for cylindrical magnet (see FIG. 46). The cylindrical magnets must be diametrically magnetized so that they attract each other from the side. Magnetic strength varies according to material, process for magnetizing and quality. Strength can be selected based on the desired amount of magnetic assistance desired by the rower or coach.

There are three possible configurations of magnets in the oarlock depending on what sort of assistance is desired. The first is catch, where the magnets are on the pin side top and the lock side bottom. The second is recovery where the magnets are on the pin side bottom and the lock side top. The third is both catch and recovery, where all four holes are filled with magnets.

Magnets can either be mounted temporarily or permanently. Epoxy is recommended when permanent installation is desired.

Pin Size Capability

Another problem in oarlocks is that in sweep rowing there are two "standard" size pins: 9/16" and 13 mm. In sculling there are also two "standard" size pins: ½" and 13 mm. The instant invention accommodates both. FIG. 17 shows the dual pin disk 21 that solves that problem by incorporating two different size holes, one large 46 and one small 45, that pass through it at 90 degrees to each other. This arrangement provides the ability to use one oarlock for either size pin 13. For sweep rowing there is typically a 9/16" hole and a 13 mm hole. In the scull implementation (not illustrated) the holes are 13 mm and ½". If other pin sizes are desired, the dual pin disk can be resized accordingly.

The holes in the dual pin disk are oblong to allow the oarlock to tilt 3 degrees of positive or negative stern pitch. The actual blade pitch is determined by the type and orientation of the pitch/depth bushings 5, which fit on the top and bottom of the dual pin disk as shown in FIG. 2.

The dual pin disk itself does not rotate but instead stays in one position on the pin. The connector 9 rotates around the dual pin disk and is connected to the pin side half 4 of the oarlock. The cap 6 is placed on the other side. The dual pin disk is sandwiched between the connector and cap, which are held together by fasteners 11, and threaded inserts 19. When not mounted on the pin, the dual pin disk is free to rotate. Depending on how these bushings are oriented, they offer a range of adjustability from 3 degrees negative pitch to 3 degrees positive pitch. They are also sized to custom fit the various pin 13 sizes.

Method for Using Spring Spacers to Simplify Oarlock Mounting

Oar height is a critical dimension. It is to be determined by a rower, coach or rigger who has a thorough understanding of the size and capability of the athlete, and the dimensions of the shell, especially seat height.

It is generally desired to have the oarlock positioned vertically in the middle of the pin, which then provides ample room for future adjustments up or down. The position of the oarlock on the pin has been traditionally set with hard nylon washers. These washers are typically different colors to accommodate different size pins. They are also available in varying thicknesses. When setting oarlock height you need to have the right combination of spacers that will result in the correct height while not allowing any free play but enough so that the oarlock can swivel. This balancing act is sometime difficult to achieve unless you have exactly the right thickness spacers.

FIG. 1 shows the oarlock assembly with spring spacers. The pin 13 is mounted on the outrigger 16. Rather than using hard nylon spacers to set oarlock height, high-tension pin springs 15 are used. These springs, typically constructed of a non-corrosive material, serve two purposes. First, they absorb abnormal shocks that occasionally occur such as catching a crab. Second, they eliminate the need to have the exact size solid spacers without causing binding or free play. Like nylon spacers, the pin springs come in different diameters and length, but are more forgiving than the spacers and easier to adjust.

The oarlock assembly 1 is positioned on the lower pin spring and oarlock height is checked with the oar in it. Once the correct height is determined and the appropriate length (and strength) pin spring is installed, the top pin spring is installed over the pin, using the smallest inside diameter possible. The top pin spring should be about 5%-10% longer than the available room, depending on pin strength, so that the oarlock assembly is held in compression—but not so much that it prevents the oarlock from swiveling.

When the oarlock is about to be mounted on the pin, the rower/coach needs to easily be able to easily rotate the dual pin disk and then be able to correctly determine which hole should be selected. The dual pin disk includes finger grips 47 (FIG. 17) that address both of these needs. First, a series of lines from one side of the dual pin disk to the other are arranged so there is more space between the lines and the smaller hole 45 than the larger one 46. This makes it easy to see which is which. Second, the lines make it easy to grip the dual pin disk and turn it, even when wet.

Adjusting Sleeve to Oarlock

In rowing, it is desirable to keep the sleeve firmly against the oarlock at all times. The main reasons are oar control and maintaining an efficient stroke. There are several reasons why this doesn't always happen, but usually it is either because of sloppy rowing on the part of the athlete or rough water conditions.

The original oarlock system was designed so that the cam blocks can easily slide into the enclosed cam track. When oriented horizontally they line up with the openings that allow the cam blocks to slide into position and rotate from catch to feathered position.

When the rower needs to quickly extract the oar from the oarlock, the rower just pulls on the oar handle and twists the handle in the direction of the openings. The problem with this system is if the rower accidentally pulls the oar out during a stroke it might take a few seconds to reinsert the oar back into the oarlock.

The ability to extract the oar is not only a convenience but also a safety issue. However, there may be situations where locking the oar into the oarlock is desired. The present invention describes a method to do this.

FIG. 3 shows the lock 7 in the open position while FIG. 4 shows the lock in the closed position. The lock mechanism consists of four parts: a thumbscrew 18, the lock 7, the threaded insert 19, which is permanently molded into the lock side 3 of the oarlock and the lock side of the oarlock 3.

In operation the lock is positioned aligned with the openings 29 for cam block (see FIG. 8). It is held tightly in place by the thumbscrew for locking. If desired the oar can be locked in the oarlock as follows: the thumbscrew is loosened and the lock turned 180 degrees using the locking knob slot 36. Finally, the thumbscrew is retightened.

In the closed or locked position the lock's cam block channel cover 35 covers the lock side half's cam block opening 29. In this configuration the oar cannot be removed from the oarlock. To unlock the oarlock, simply reverse the above procedure.

Improved Methods of Moving and Locking the Cam Blocks that Control Inboard

In the current state of the art, "inboard" is adjusted by using a screwdriver to re-position a collar around a sleeve that is fixed to the oar shaft thereby changing the leverage. The need to use a tool makes it difficult to make last minute adjustments on the water.

The previously filed oarlock system describes a system where there is an inboard adjusting system consisting of two cam blocks positioned 180 degrees apart around the sleeve. The cam blocks slide into position along a track that runs longitudinally on the sleeve and held in place by a system of interlocking ridges. When the correct inboard setting was reached, the cam block hinged down and locked into position. It has been discovered that this system has several shortcomings. The cam block and sleeves are prone to wear, and thus become unreliable. It is also possible to misalign the cam blocks so that they do not fit into the oarlock properly. Finally, the cam blocks might slip out of the sleeve. The instant invention addresses these issues.

FIG. 21 shows the two-piece platform on which the assembled sleeves 60 and the retained collar 74 (FIG. 31) and end cap 80 (FIG. 35) are based. Referring now to FIG. 43 this implementation consists of fastening two sleeve halves 60*a* and 60*b* together around the oar shaft 85.

Besides the two-piece sleeve, as noted above, there are three designs that utilize a simplified one-piece design: threaded 121, bolted 128 and ring 132, and shown in FIGS. 55-60. All of the above sleeves can be manufactured in various lengths and diameters to accommodate any size oar shaft and any length inboard adjustment requirements.

In the present invention there are three improved methods for adjusting inboard. The preferred is the "threaded"

method, in which the cam blocks 54 move along threaded rods 56 in the sleeve assembly 60. Within this preferred embodiment are several methods for turning the threaded rod, as discussed below. The second method for moving the cam blocks is the ring method as shown in FIGS. 59 and 60. Here, the cam blocks are mounted on the outside of a cylinder 134 that twists along a one-piece threaded sleeve 133. The third method, as shown, for example, in FIG. 57, uses a fastener to hold the cam block in a threaded hole.

Cam blocks and sleeves not specifically labeled as (threaded), (ring) or (bolted), apply to all three systems. Additionally, all threaded cam blocks including the one piece cam block 54, the adjustable pitch cam block 100, and the bolted-roller cam block 109 and the snap-on roller cam block 110 can be used interchangeably.

The Threaded Sleeve and Cam Block System

In this system shown, for example in FIG. 21, the cam block 54 is moved within the sleeve by turning a threaded rod, as noted above. In the instant invention three methods of turning the threaded rod collar in the assembled sleeve 60 (which is preferred end cap 79. As shown in FIG. 25 and related figures, the first two methods use collars that incorporate an internal ring gear 61 that turns a spur gear 52 on each of the two threaded rods 56. The primary difference between these two options is size and weight on one hand, and the ease of adjusting the inboard on the other. In the case of the end cap of FIG. 25, four fasteners 11 need to be removed on the collar prior to turning the adjustment collar 59. The retained collar 71 of FIG. 29 et seq., on the other hand is larger and heavier but can be turned without removing any hardware, so no tools are required.

The third method does not include a collar at all but involves the independent turning of each individual spur gear with the user's thumb. When both cam blocks have been moved to their proper position, an end cap 80 (see FIGS. 35-37) is bolted on to the handle end of the sleeve using four fasteners 11. Ultimately it is up to each rower/coach to determine which features are more important to them. Whatever collar or end cap is selected, they all serve to provide a circular surface that allows them to be hung from traditional oar racks.

As noted above, the preferred embodiment is a two-piece sleeve 60 with a bolted collar 59. In this embodiment, inboard is adjusted by moving two threaded cam blocks along the inboard adjustment channel 55 by turning a threaded rod 56, thereby providing an infinite number of inboard settings.

FIG. 31 shows a spur gear assembly 62 to move the threaded cam blocks 54. The main component is the threaded rod 56. There is one threaded rod in each sleeve half 141 and two in each complete sleeve assembly 60. It passes through the access holes for threaded rod 58. If the threaded rod is turned to the right or clockwise, it pulls the cam block along the inboard adjustment channel 55 towards the oar handle end of sleeve 138, thereby reducing inboard. Conversely, when the threaded rod is turned to the left, or counter-clockwise, the cam block moves away from the oar handle end and towards the tapered (blade) end of sleeve 140, thereby increasing inboard.

This spur gear assembly 62 of FIG. 26, applies to all two-piece sleeve implementations of the present invention. The spur gear 52 provides the turning force to the rod. It must be affixed to the threaded rod 56 so that it cannot turn relative to it. This is accomplished with a lock washer 65 and lock nut on either side. Once the gear and threaded rod are in their proper position in the sleeve, split ring spacers 63 are placed on the outside of the lock nuts to take up the free play between the inside walls of the gear assembly cavity 139 taking up any lateral free play and eliminates the need for constraints on the ends of the threaded rods.

The one-piece sleeve 120 (FIGS. 55-56) also utilizes a threaded rod 56 to move the cam block along an inboard adjustment channel 55. This implementation however is simplified to save size, weight and cost by eliminating many of the components of the two-piece sleeve design. These include the collar, end cap, gear assembly cavity and the gear assembly. Instead, a pair of acorn nuts 125 and flat washers 113 is used on either side of the threaded rod. Other simple ways of turning either end of the threaded rod can be implemented which include a hex or screw slot or even a thumb wheel to eliminate the need for tools.

Ring Sleeve and Cam Blocks System

This second sleeve solution, the ring system, describes an improved method for hand adjusting inboard using a one-piece sleeve with threads running along its outside length, cam blocks mounted 180 degrees apart on an internally threaded cylinder and two locking rings to hold it in place. Once the ring sleeve cylinder 131 has been mounted on the oar, inboard is adjusted by turning the cam block ring 134 around the sleeve. From the rower's perspective turning it clockwise increases inboard while turning it counter-clockwise decreases inboard. An noted above, this design (FIGS. 59-60) consists of a cam block ring 134 that contains two cam blocks 126 mounted 180 degrees apart. Two locking rings 136 are on either side to lock the cam block ring into position. The locking rings feature a knurled outside surface and a large threaded inside surface. These threads **133*a* mesh with the outside threads of the ring sleeve cylinder 133 that run axially along its length. The cam block ring has a smooth outer surface and inside threads to allow it to be turned longitudinally up and down the (ring) sleeve cylinder 133**.

The Ring sleeve's outer threads **133*a* are designed so that each turn moves the Ring cam blocks a certain distance longitudinally (ex. ½ centimeter). It is important to note that when adjusting inboard, the (ring) cam blocks must be returned to one of the blade pitch indicators 136; otherwise blade pitch will not be right. Markings around the circumference of ring sleeve cylinder 131 and the ring sleeve cylinder allow the rower to make this adjustment easily and consistently. Once the cam block ring 134 is in the proper position one locking ring 135** tightened against one side and then the other locking ring is tightened against the other side. This insures that both the blade pitch and inboard will not change.

Sleeve/Cam Blocks Bolted

The third method of adjusting inboard consists of using a fastener to bolt the cam blocks into one of a series of threaded holes along the length of the sleeve. Like the other one-piece sleeves, this was designed with the goals of simplicity, light weight and low cost. FIG. 57 shows a one-piece sleeve design 128 that features an inboard adjustment bar with tapped holes 129, 180 degrees apart. The threaded cam block bolted roller barrel 111 is screwed into one of the holes using a fastener 11. Inboard is adjusted by selecting the hole that most closely matches the desired inboard. Recommended distance between holes is ½ centimeter. The hex wrench 66 for this fastener can be stored in the Hexagonal Wrench Bay **66*a***. There are two bays on each sleeve half—each accommodating a different size fastener. Together they can many of the fasteners used on the sleeve and oarlock.

A Method for Replacing Worn Cam Blocks

In the instant invention there are five different versions of the cam block. All five follow the cam block channels 25 to both assist the oar blade in getting in the proper position and to limit the oar's rotation as defined by the length of the cam block channels.

Four of the designs share a threaded hole 67 in their base: the threaded cam block one piece 54, the threaded cam block with adjustable pitch 100, the threaded cam block with snap-on roller 115 and the threaded cam block with a bolted roller 109. As noted above, a threaded rod 56 runs through the holes 67 in each of these designs and moves the cam blocks along an inboard adjustment channel 55 to change an oar's inboard. This configuration allows for the replacement of worn barrels, without removing the base from the threaded rod and removing the spur gear assembly from the sleeve. The first two cam blocks, 100 and 109 are held together with a fasteners 11 while cam block 115 uses a snap-on stem 118 to firmly hold the inside cylinder 119 of the barrel 116. The barrels on 109 and 115 are designed to rotate while moving in the cam channels 25 thereby minimizing wear. The barrel of the adjustable pitch cam block does not rotate but can be turned 180 degrees to double its life. Additionally materials with a low coefficient of friction such as DELRIN (acetal) are recommended for these parts.

The threaded cam block with the bolted roller barrel 111 can be replaced by removing the retaining fastener 11 with a hex wrench from the inboard adjustment bar with tapped holes 129 and replacing it with a new one.

The only one-piece cam block design is the one-piece threaded cam block 54, which has a vertical hole in the top of the barrel, which can accept an optional cylindrical magnet. This cam block simple design makes it both reliable and inexpensive. The downside is that when the barrel wears down, the entire spur gear assembly 62 has to be removed in order for the cam block to be replaced. This cam block however, can be turned 180 degrees when showing signs of wear, which essentially doubles its life.

Finally, the cam blocks on ring are integrated on the surface of the cam block ring 134 in the same axial plane 180 degrees apart. When the cam blocks show signs of wear the cam block ring can be turned around so the fresh half of the barrel is used thereby doubling its life.

Materials for the improved oarlock system are ABS plastic, glass or carbon fiber reinforced nylon or Acetal thermoplastic. Parts could also be made of composites such as carbon fiber or even strong, lightweight metals such as aluminum or titanium.

Manufacture

Preferred method of manufacture for most of the parts used to construct the present invention is injection molding. Other methods of manufacture such as CNC could be used and would be appropriate if other materials were used in the construction, such as aluminum or titanium.

Off-the-shelf parts such as the thumb screw on the oarlock, the stainless steel and cylindrical magnets on the sleeve and stainless steel fasteners and brass inserts may be purchased rather than fabricated.

The modular design of the present invention allows the unit to be disassembled to be cleaned and/or replace worn or damaged parts. It is possible however, to employ plastic welding manufacturing techniques e.g., hotplate, ultrasonic, vibration, friction, solvents and spin welding to join parts such as the cap to the connector and the connector to the oar half permanently. Additionally, glue or two-part epoxy that is appropriate for the chosen materials may also be used.

Joining parts permanently has both positive and negative consequences. On the positive side, this method would reduce the weight and assembly cost of the oarlock by eliminating heavy and expensive stainless steel fasteners, would eliminate the possibility of those fasteners loosening up over time and may even make it marginally stronger. On the negative side, permanent welding makes disassembly of the unit for cleaning or replacing of worn or damaged parts impossible.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. An oarlock system for use on an oar having a shaft comprising:

a) a sleeve, removably attached directly to the surface of said shaft of said oar, said sleeve having an adjustment channel, having a length formed therein, said adjustment channel being in alignment with the longitudinal axis of said oar such that the length of the adjustment channel is parallel to the shaft of said oar;

b) a cam block, adjustably attached to said sleeve and having a cam portion extending outwardly therefrom, said cam portion fitting into said adjustment channel to permit positioning of said cam portion along the length of said adjustment channel;

c) a means for temporarily fixing said cam block in a position on said sleeve;

d) an oar retainer including:

i) two semicircular members designated as the oarlock lock side half, and the pin side half, said two semicircular members being hingably connected;

ii) a latch, attached to said two semicircular members to temporarily lock said two semicircular members together; and further wherein iii) said oar retainer being positioned perpendicularly to the length of said adjustment channel;

e) a means for engaging said cam block, formed within said oar retainer; and f) a means for attaching said oar retainer to a watercraft;

g) wherein the combination of said sleeve, and cam block allows said oar retainer to be moved along the length of said adjustment channel to permit an inboard adjustment in the position of said shaft with respect to said watercraft without removing said oar retainer.

2. The oarlock system of claim 1 wherein the means for attaching said oar retainer to a watercraft comprises:

a) a pin;

b) a connector;

c) a dual pin disk having two pitch-depth bushings; and d) a cap.

3. The oarlock system of claim 2 wherein the dual pin disk has two pairs of oblong holes that allow it to slide over two different size pins while maintaining the ability to change pitch.

4. The oarlock system of claim 2 wherein the dual pin disk remains in one position on the pin.

5. The oarlock system of claim 2 wherein the connector rotates around the dual pin disk.

6. The oarlock system of claim 2 wherein the connector is connected to the oarlock on one side of said oarlock.

7. The oarlock system of claim 2 wherein the dual pin disk is inserted into the connector.

8. The oarlock system of claim 1 wherein the pitch-depth bushings fit around the pin 13, by being positioned on the top and bottom of the dual pin disk.

9. The oarlock system of claim 8 wherein the pitch-depth bushings set the pitch of the oarlock and limit the depth of the blade.

10. The oarlock system of claim 1 wherein the pin is mounted on the outrigger.

11. The oarlock system of claim 1 wherein an oarlock height is achieved using high-tension pin springs about said pin.

12. The oarlock system of claim 1 wherein said oarlock is round.

13. The oarlock system of claim 1 wherein the sleeve further comprises: a numerical scale formed on said sleeve adjacent to the adjustment channel.

14. The oarlock system of claim 1 wherein the means for temporarily fixing said cam block in a position comprise:

a) a plurality of teeth formed about said adjustment channel on said sleeve;

b) a retaining rod, passed through said cam block and having one end secured in said sleeve; and c) a retainer, removably secured in said sleeve to hold said retaining rod in place.

15. The oarlock system of claim 1 wherein the means for temporarily fixing said cam block in a position comprise:

a) a retainer ring, slidably attached to said sleeve and having a tightening thread formed thereon; and b) a tightening thread formed on said cam block such that when said tightening thread formed on said retainer ring engages said tightening thread formed on said cam block, said cam block is locked in place.

16. The oarlock system of claim 1 wherein the means for temporarily fixing said cam block in a position comprise:

a) a) a plurality of teeth formed about said adjustment channel on said sleeve;

b) a hinge channel formed in said sleeve and positioned above and parallel to said adjustment channel; and c) a cylindrical hinge member, formed on said cam block whereby when said cylindrical hinge member is positioned in said hinge channel, said cam block is slidably attached to said sleeve;

d) whereby said cam block further having a set of lugs for frictionally engaging said plurality of teeth on said sleeve to lock said cam block in a desired position.

17. The oarlock system of claim 1 wherein the latch on said oar retainers is manually operated.

* * * * *